US009764878B2

(12) United States Patent
Semer

(10) Patent No.: US 9,764,878 B2
(45) Date of Patent: Sep. 19, 2017

(54) SANITARY LOCKING STORAGE BOX

(71) Applicant: Passionate Playground LLC, Seattle, WA (US)

(72) Inventor: Deborah Semer, Seattle, WA (US)

(73) Assignee: PASSIONATE PLAYGROUND LLC, Seattle, WA (US)

( * ) Notice: Subject to any disclaimer, the term of this patent is extended or adjusted under 35 U.S.C. 154(b) by 325 days.

(21) Appl. No.: 14/602,231

(22) Filed: Jan. 21, 2015

(65) Prior Publication Data

US 2015/0203269 A1 Jul. 23, 2015

Related U.S. Application Data

(60) Provisional application No. 61/929,926, filed on Jan. 21, 2014, provisional application No. 62/017,135, filed on Jun. 25, 2014.

(51) Int. Cl.

| | |
|---|---|
| ***A45C 13/10*** | (2006.01) |
| ***B65D 43/16*** | (2006.01) |
| ***B65D 25/00*** | (2006.01) |
| ***B65D 43/22*** | (2006.01) |
| ***B65D 51/28*** | (2006.01) |
| ***A45C 5/00*** | (2006.01) |
| ***A45C 11/24*** | (2006.01) |
| ***A45C 13/00*** | (2006.01) |
| *A61H 19/00* | (2006.01) |

(52) U.S. Cl.

CPC ..... *B65D 43/16* (2013.01); *A45C 5/005* (2013.01); *A45C 11/24* (2013.01); *A45C 13/00* (2013.01); *B65D 25/00* (2013.01); *B65D 43/22* (2013.01); *B65D 51/28* (2013.01); *A45C 2200/00* (2013.01); *A61H 19/00* (2013.01)

(58) Field of Classification Search

CPC ..... B65D 43/16; B65D 25/00; B65D 43/22; B65D 51/28; A61H 19/00; A45C 5/005; A45C 11/24

USPC ..... 206/1.5, 69, 349, 372, 373, 562, 564; 220/254.3, 254.6, 315, 366.1, 529, 745, 220/810, 836, 324

See application file for complete search history.

(56) References Cited

U.S. PATENT DOCUMENTS 4,615,464 A * 10/1986 Byrns ..... B29C 49/0031 16/341
5,341,926 A * 8/1994 Leben ..... G11B 23/023 206/307
5,386,907 A * 2/1995 Kahl ..... A01K 97/06 206/315.11

(Continued)

*Primary Examiner* — Luan K Bui
(74) *Attorney, Agent, or Firm* — Baker & Hostetler LLP

(57) ABSTRACT

A storage system for adult products includes a box, a lid, a locking mechanism and a ventilated tray. The box has an upper rim with a plurality of ventilation holes formed therein. The lid is hinged to the back of the box and configured to mate with the upper rim of the box without closing the plurality of ventilation holes. The lid includes a compartment formed within the top of the lid with a mini lid covering the compartment. The locking mechanism includes a sliding lock for securing the lid to the box. The sliding lock fits over a split lower rail of the box and an upper rail of the lid that includes an extended tab mates with the split lower rail and secures the lid to the box when the sliding mechanism is moved so as to fit over both rails at the same time.

17 Claims, 29 Drawing Sheets

(56) References Cited

U.S. PATENT DOCUMENTS

| | | | | | |
|---|---|---|---|---|---|
| 5,769,235 | A * | 6/1998 | Keach | B65D 81/075 | 206/583 |
| 5,819,976 | A * | 10/1998 | Boehm | B65D 51/28 | 206/217 |
| 5,988,387 | A * | 11/1999 | Staal | B65D 43/165 | 206/1.5 |
| 6,213,296 | B1 * | 4/2001 | Streich | A45C 5/00 | 206/373 |
| 2003/0106821 | A1 * | 6/2003 | Bar-Erez | B25H 3/003 | 206/373 |
| 2005/0236290 | A1 * | 10/2005 | Ohi | A01K 97/06 | 206/373 |

* cited by examiner

SANITARY LOCKING STORAGE BOX

CROSS REFERENCE TO RELATED APPLICATIONS

This application claims benefit under 35 U.S.C. §119(e) of Provisional U.S. Patent Application No. 61/929,926, filed Jan. 21, 2014, and of Provisional U.S. Patent Application No. 62/017,135, filed Jun. 25, 2014, the contents of each of which are incorporated herein by reference in their entirety.

TECHNICAL FIELD

The present disclosure relates to storage containers, and more particularly storage containers for containing objects in a hygienic condition.

BACKGROUND

The term "adult product" is often used to refer to what are more commonly known as "sex toys." Sex toys are objects that are primarily used to facilitate human sexual pleasure, such as dildos, vibrators, penile toys, nipple toys, anal toys, etc. Due to the personal nature of these objects and the stigma often associated with their use, people often try to find places to store or hide the objects when not in use, such as nightstands, dresser drawers, under beds, in tightly closed boxes, etc. These objects are also often used in combination with a variety of lubricants that also need to be stored, but which may present leakage issues. Such objects may also be used for some period of time, and then put aside or away for some period of time before being used again. While they should be, the objects are not always washed in-between uses, which creates a variety of health and sanitary issues.

When used (unwashed) objects are put in a drawer, box, under a bed or other storage locations, those locations may be contaminated. If an object is cleaned after use, but then put in the same location as previously unwashed objects, the cleaned object may be contaminated. Dust and other chemical particles in the locations may further to contaminate the objects. Further, some storage locations may actually be toxic. Storage containers with vinyl interiors, especially when not ventilated, may react to the material used to make the object, causing the vinyl to breakdown and further contaminate the object with various chemicals, which may be topic to the person subsequently using the object. Hence, a safe and sanitary storage system is needed.

At the same time, discretion and secure privacy are also important. People sharing housing with others, whether roommates, parents or children, do not necessarily want to share their intimate activities with those around them. Dresser drawers, nightstands and certain types of boxes stored under one's bed can present themselves as tempting targets for someone interested in snooping on those they live around. If a storage system proudly proclaims what it is from the outside, it may not be necessary to open it to have an idea of what is inside.

SUMMARY

A storage system for discretely containing adult products, and other objects, in a private, sanitary, and secure location is described. The system is comprised of a ventilated box having a lid and formed of food grade, bisphenol A (BPA) free, plastic. The box is large and deep enough to hold a variety of popular adult products or other items, with the lid completely closed, and includes a removable tray upon which certain adult products can be stored between uses. The tray includes ventilation slots, ribs and edges to keep the object in place and from sticking on the tray and is raised up off the bottom surface of the box so the used items do not contact other surfaces on the inside of the box. The tray may be removed and safely washed in a dishwasher to disinfect the tray. The entire box may also be safely washed in a dishwasher. The tray may also be stored within the box against a side of the box when not needed to free up other room within the box. The lid includes a separate compartment, accessible from the top of the box, for storing additional items, such as liquid containers, condoms, etc. The box includes a locking mechanism that includes a two-part rail system and a sliding lock that can be held in place by a small projection on the bottom rail, and the option for a separate mini lock.

DETAILED DESCRIPTION OF ILLUSTRATIVE EMBODIMENTS

Figure 1:
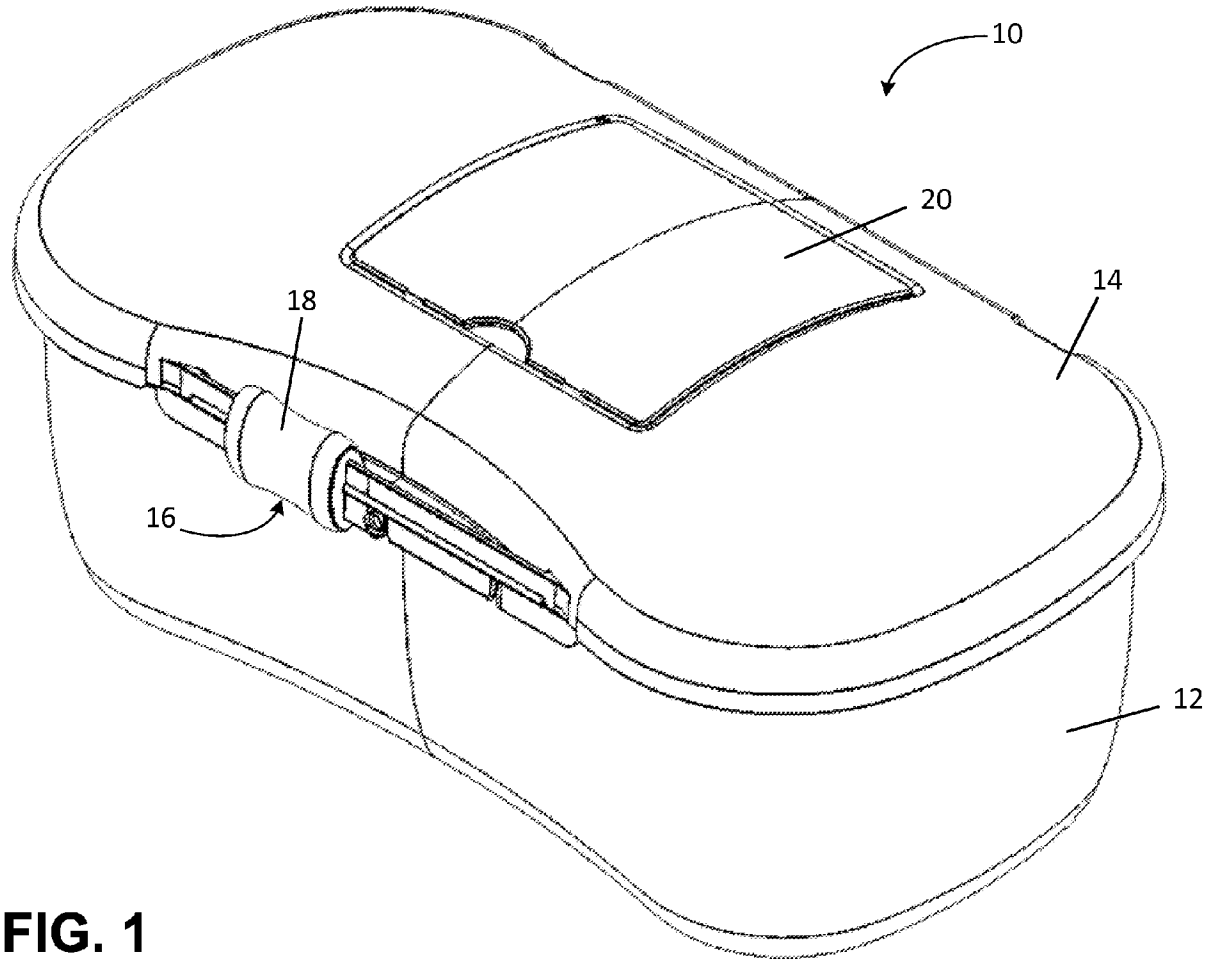
FIG. 1 is a perspective view of the storage system illustrating the mini lid and locking mechanism in accordance with an embodiment.

An embodiment of a storage system in accordance with the present disclosure is illustrated by the various figures herein, but is not limited according to such figures and may be varied and altered by persons of ordinary skill in the art without departing from the scope of the present disclosure. A perspective view of the storage system 10 is illustrated in FIG. 1, showing the storage system, which is comprised of a box 12 and a lid 14 (or first lid) with a locking mechanism 16, when the lid 14 is in its closed position and the sliding lock 18 of the locking mechanism 16 is in its locked position. FIG. 1 also illustrates the mini lid 20 (or second lid) within the first lid 14 when the second lid 20 is in its closed position. The box 12 is made of a plastic material, such as a food grade or pharmaceutical grade plastic that is made from plastic material that may be antibacterial in its newly manufactured state. The plastic materials may also be BPA free and may include one or more additives that include antimicrobial agents so the plastic material will continue to have antibacterial, antifungal and other antimicrobial features throughout its useful life. Once such additive is 2/9 $AG_2O.(P_2O_5.ZnO)m.(2CaO.3B_2O_3)n$, which is sold under the brand name MILLION KILLER by Shangai Wako Chemical Col., Ltd., of China, and which contains silver ion particles in a glass network structure that are slowly released over time and allow the plastic material to which they are added retain an antimicrobial effect for an extended period of time.

Figure 2:
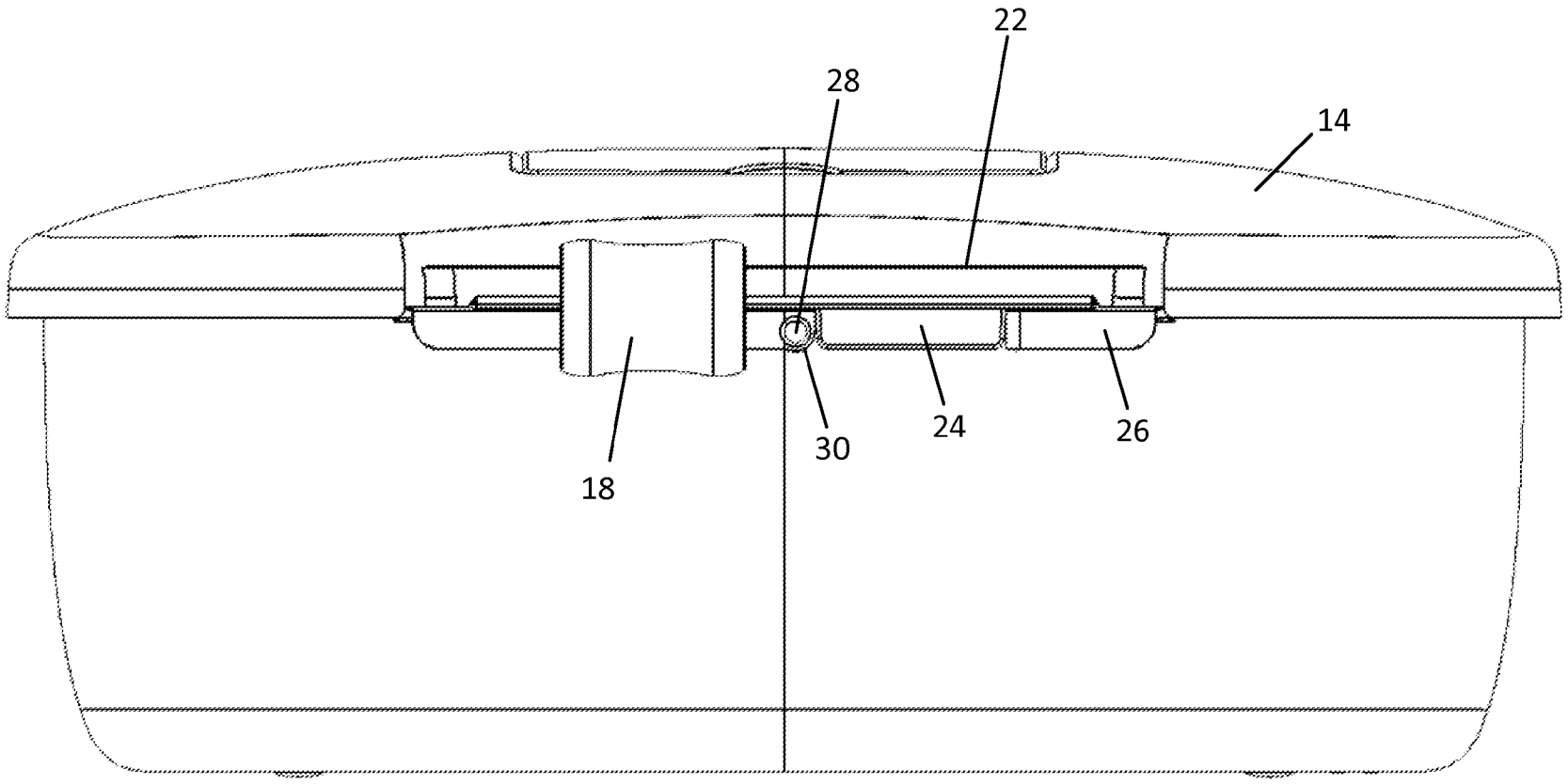
FIG. 2 is a front view of the storage system further illustrating the locking mechanism.

FIG. 2 is a front view of the storage system illustrated in FIG. 1, further showing the sliding lock 18 of the locking mechanism 16 in its closed position. The sliding lock 18 slides along an upper rail 22 with an extended tab projection 24, formed by the lid 14, and a split bottom rail 26, formed by the box. The upper rail and bottom rail come together when the lid is closed completely. The tab projection of the upper rail extends down and into an indented area formed in the split bottom rail. When the sliding lock is completely positioned over the tab projection and the indented area, called the "lid open position," the lid to the storage system may be opened. When the sliding lock is not in the lid open position, or only partially in the lid open position, it will not be possible to open the lid without further moving the sliding lock. A small hole 28 formed in the bottom rail next to the indented area is configured to accommodate the shackle for a small padlock that may be used to further hold the sliding lock in the locking position, i.e., when the sliding lock is moved to the left of the small hole so it is not in the lid open position. The bottom rail has a small projection or bump 30 below the small hole that extends beyond the bottom or the remainder of the bottom rail. This bump is configured to provide sufficient resistance against the sliding lock to prevent the sliding lock from easily sliding toward the lid open position. When moving the sliding lock from the lid open position to the locking position, a user would need to exert enough force on the sliding lock to overcome the resistance created by the bump, and likewise when moving the sliding lock from the locked position to the lid open position. Other locking mechanisms could also be used.

Figure 3B:
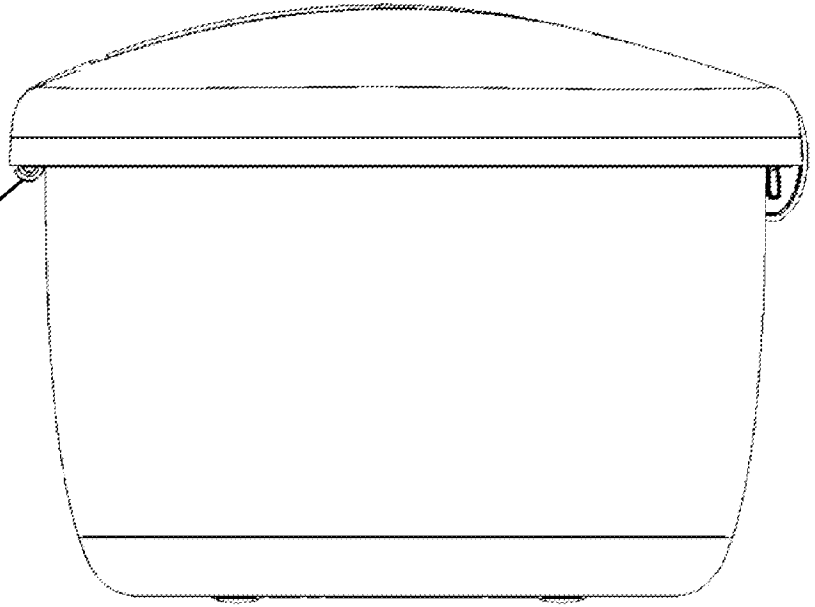
FIGS. 3A and 3B are left and right side views of the storage system.
Figure 3A:
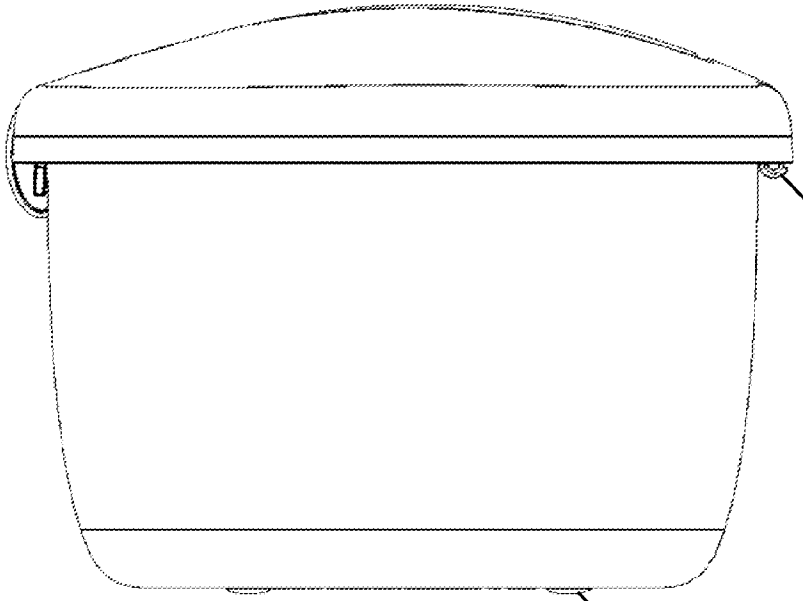
Figure 4:
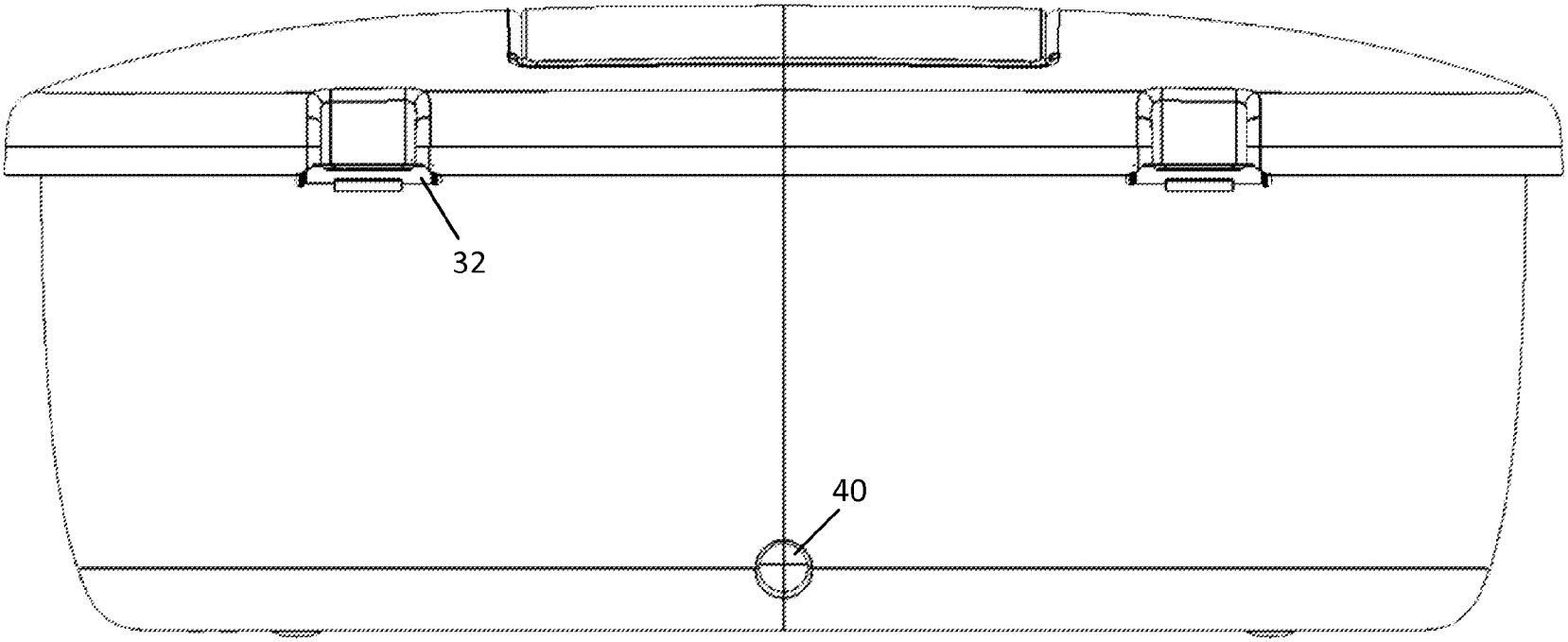
FIG. 4 is a back view of the storage system illustrating the hinges.

FIGS. 3A and 3B are left and right side views of the storage system. The side view help to illustrate the curved shape of the lid with the mini lid and compartment therein, as well as the hinges 32 that attach the lid to the box and the feet 34 on the bottom of the box that serve to slightly elevate the box from a surface upon which it rests. The hinges 32 attaching the lid to the box are further illustrated in FIG. 4, which is a back view of the storage system. A small, optional hole 40 is also depicted near the bottom of the back of the storage system. This hole may serve a number of functions, including as a through hole for a power adapter cord used to recharge battery powered items stored in the storage system. The hole may also provide additional drainage for when the storage system has been washed out and provide additional ventilation.

Figure 5:
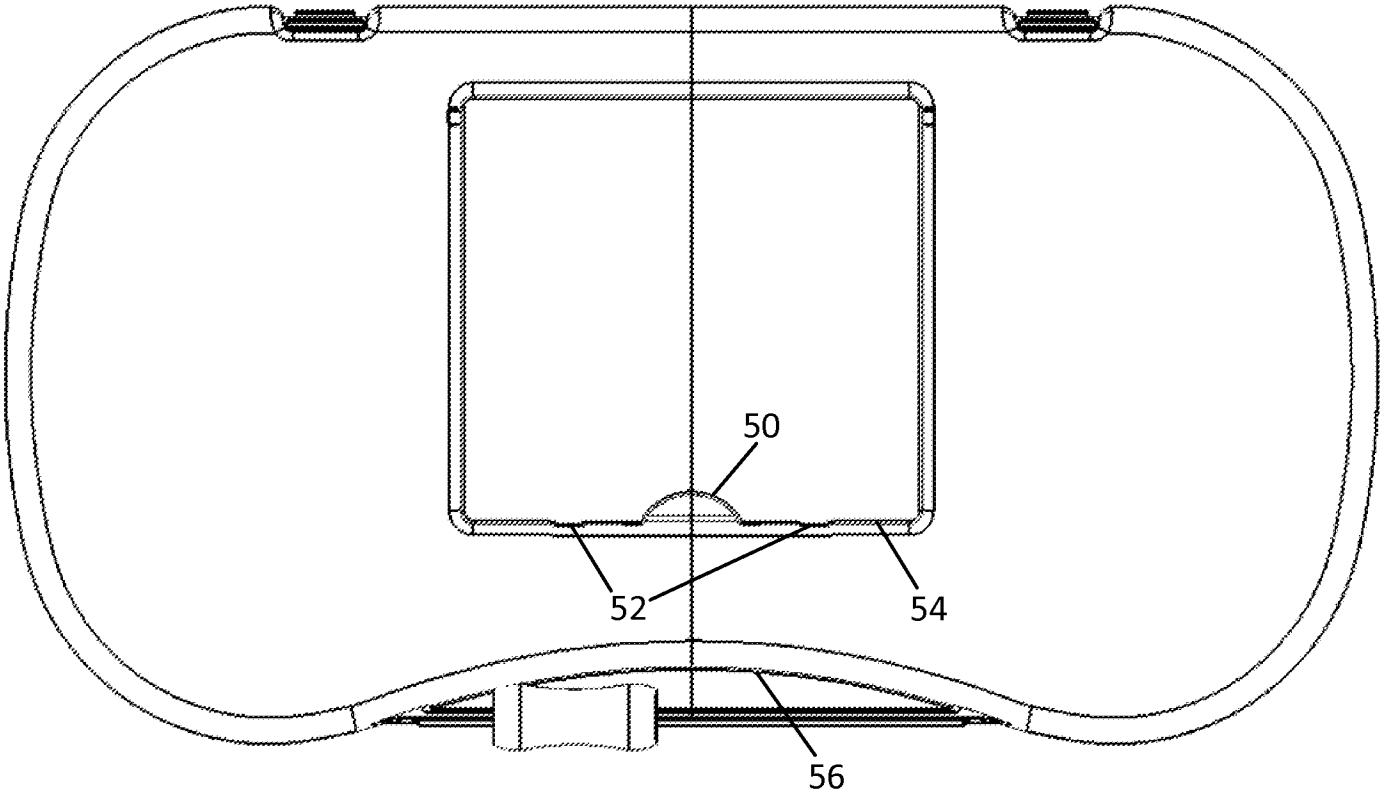
FIG. 5 is a top view of the storage system further illustrating the mini lid and locking mechanism.

FIG. 5 is a top view of the storage system further illustrating the mini lid or second lid and the locking mechanism. The mini lid includes a semicircular indent 50 toward the front of the mini lid that is configured to enable a user to place a fingertip within the indent so as to get under the mini lid and lift the mini lid up for access to the compartment over which the mini lid is placed. The mini lid includes two small tabs 52 on the front edge 54 of the mini lid that are configured to mate with the edge of the compartment formed in the lid and serve to hold the mini lid in place. The two tabs slip over the edge when pressure is exerted from above the mini lid and hold the mini lid in place within the lid. The user lifting the mini lid will need to exert sufficient pressure when attempting to open the mini lid to overcome the resistance created by the interaction between the two tabs and the edge of the compartment. The mini lid is hinged toward the back of the compartment so that the mini lid only swings open from the front of the storage system.

FIG. 5 also illustrates the locking mechanism is being formed within an indented area 56 of the storage system formed by the box and the lid. The locking mechanism could protrude from the sides of the storage system, with the sliding lock contained to the upper and lower rails by tabs or ends extending from the side of the box so the slide lock did not slide off either end of the rails. The indented area provides a sleeker, more aesthetic solution that contains the sliding lock to the rails by having the side of the storage system curve in sufficiently so as to block the end of the rails, yet allowing sufficient room for the sliding lock to move back and forth between its unlocked (lid open) and locked positions.

Figure 6:
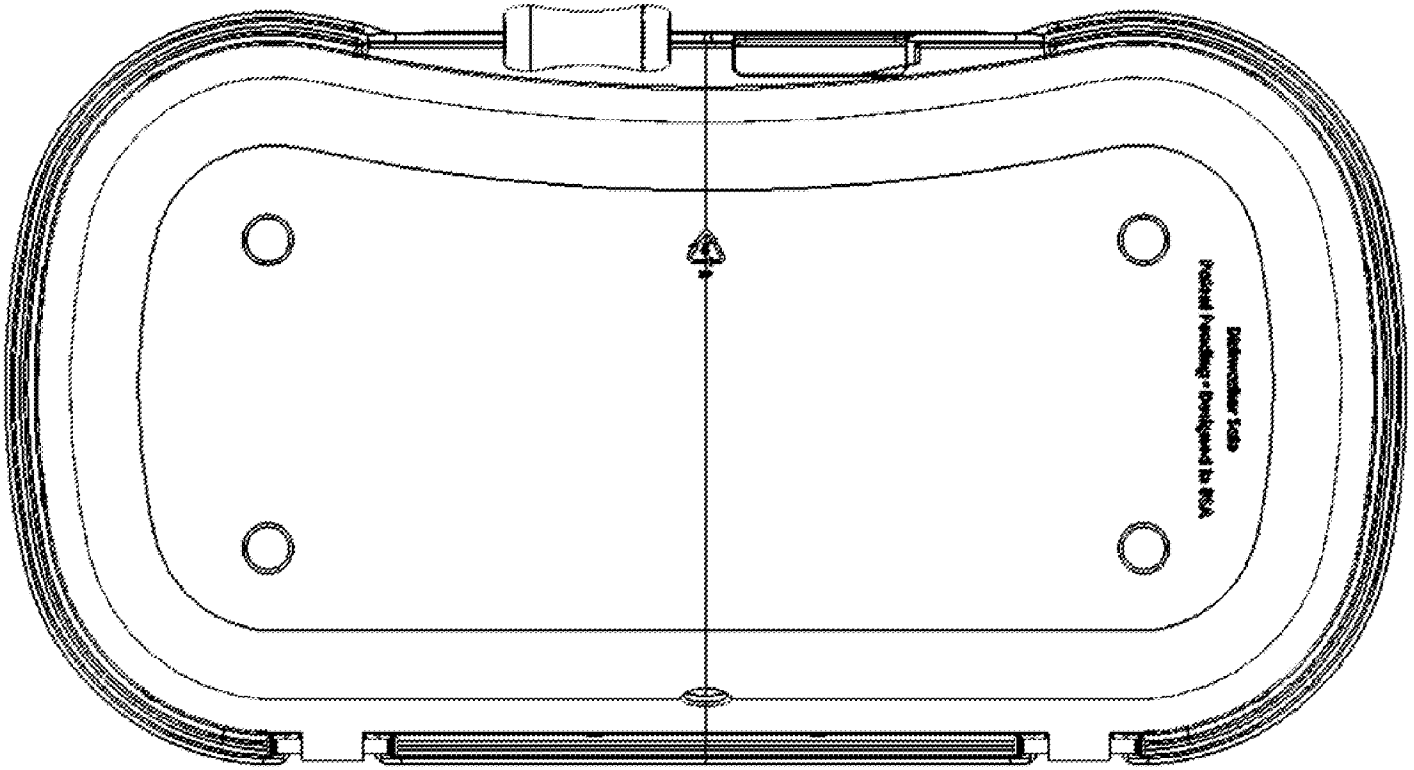
FIG. 6 is a bottom view of the storage system further illustrating the locking mechanism and hinges and illustrating the feet for the box.

The bottom rail of the locking mechanism is further illustrated in FIG. 6, which shows a bottom view of the storage system and the feet for the box. As illustrated, the sliding lock is in the locked position, with the indented area of the bottom rail to the right of the sliding lock. A small lateral tab on the bottom rail, to the right of the indented area, prevents the sliding lock from sliding past the indented area.

Figure 7:
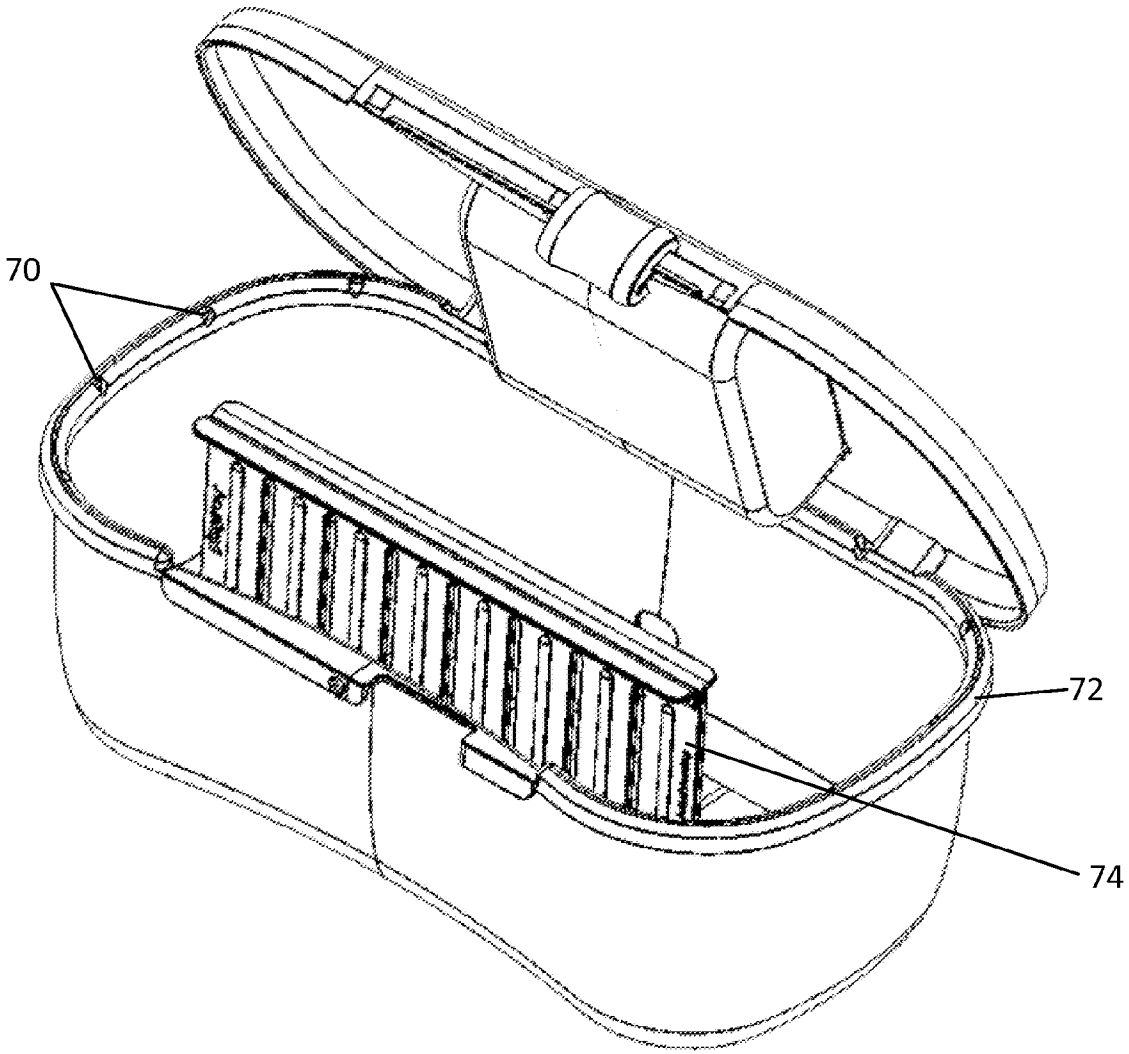
FIG. 7 is a perspective view of the storage system, with the lid partially opened and illustrating the tray in a storage position and ventilation holes formed around the rim of the box.

The bottom of the hinges are also illustrated in FIG. 6, where the hinge is comprised of a round dowel and a swivel tab that hooks around the round dowel and secures the lid to the box. The hinges enable the lid to swing up and away from the front of the box, as illustrated in FIG. 7, which shows the storage system with the lid partially opened. The lid may open further such that the lid is substantially perpendicular to the bottom of the box. As will be further illustrated below, the lid includes a compartment, the outside bottom of which is illustrated in FIG. 7 with the lid partially open. The box may also include a tray, which is illustrated in FIG. 7 in its storage position. Each side of the tray includes a groove running from one end of the tray to other end of tray. A tongue extending upward from the bottom inside of the box fits within the groove when either side of the tray is placed over the tongue, thereby holding the tray on its side in its storage position inside the box. The tray if further described below.

The top of the box is formed by a rim that is configured to include a number of ventilation holes formed within the rim. As illustrated in FIG. 7, there are at least eight to ten ventilation holes 70, four to five on the right side of the box and four to five on the left side of the box, in addition to any other optional ventilation holes in the bottom of the box. By placing the ventilation holes in the rim 72 of the box, the holes are at the highest points of the sides of the box where moisture or condensation may otherwise collect and are discretely hidden so it is not obvious that the storage system is a ventilated box to the casual observer. Hiding the ventilation holes in the rim of the box and lid also serves to prevent someone from attempting to look into the storage system when it is locked and otherwise not openable. FIG. 7 also illustrates the lid 74 in its storage position on the middle bottom of the box.

Figure 8:
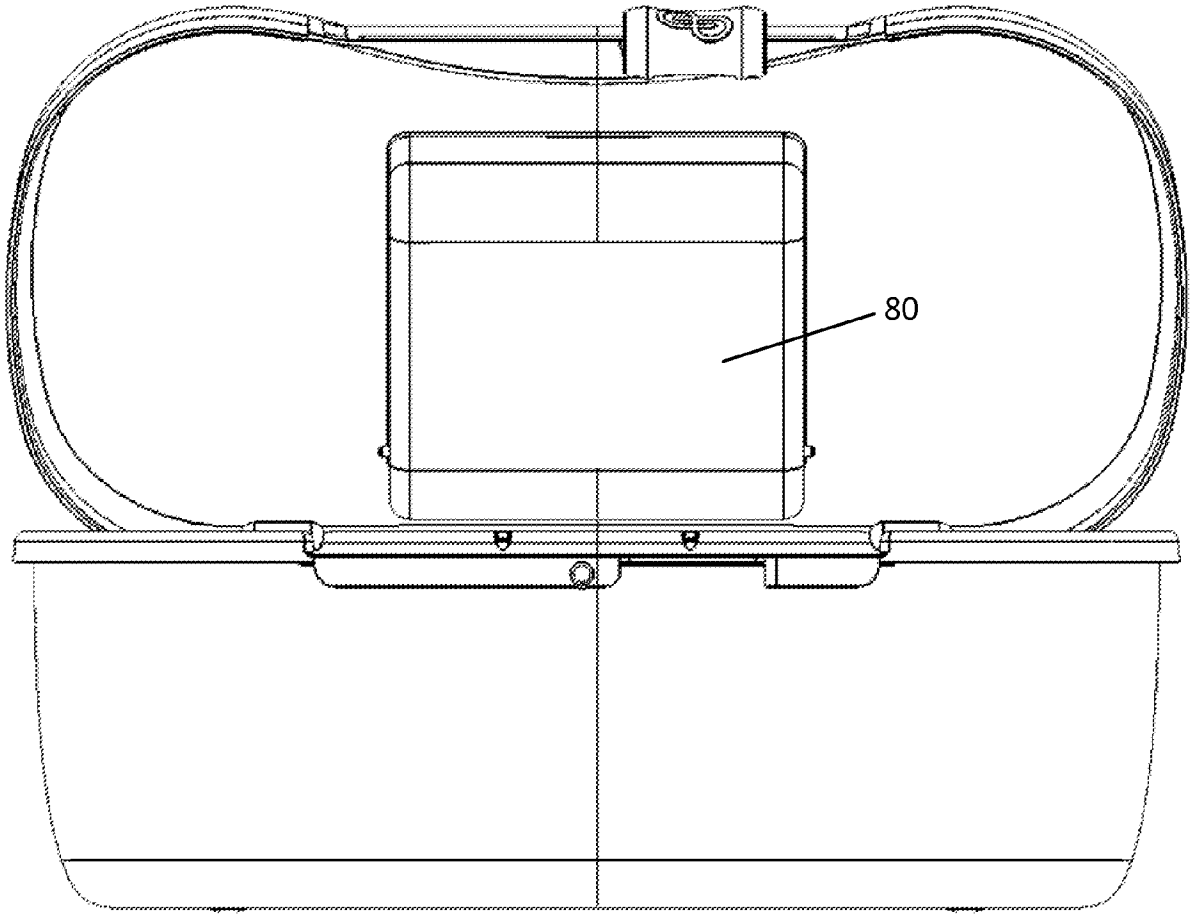
FIG. 8 is a front view of the storage system with the lid partially open and illustrating where discreet, internal identification may be located.

FIG. 8 is a front view of the storage system with the lid partially open and illustrating a location at the bottom of the compartment 80 within the lid where discreet identification could be added. By putting identification inside the storage system, such as branding information, the user of the storage system is reminded of the source of origin of the storage system each time it is opened, but no one else is made aware of the origin of the storage system, which might make it possible for them to look up the identification on the Internet and figure out what the storage system may contain.

Figure 9B:
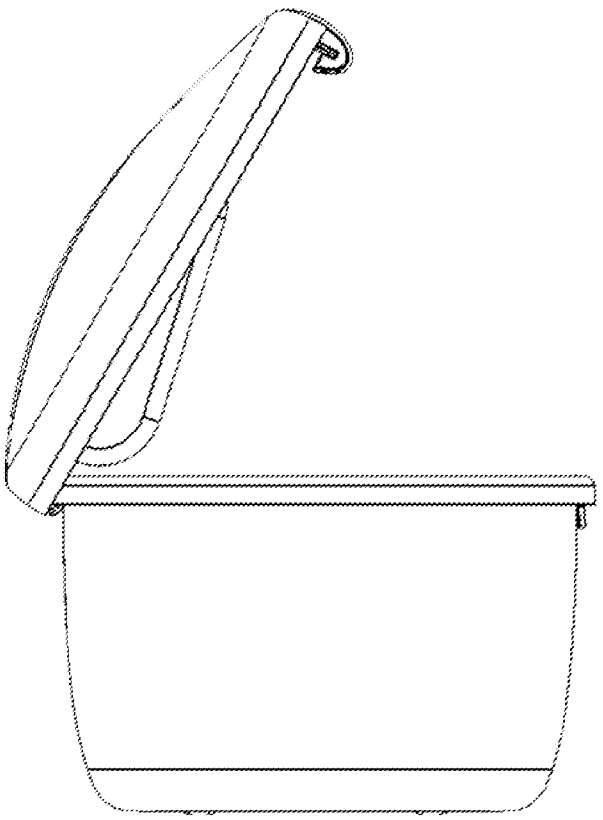
FIGS. 9A and 9B are left and right side views of the storage system with the lid partially open.
Figure 9A:
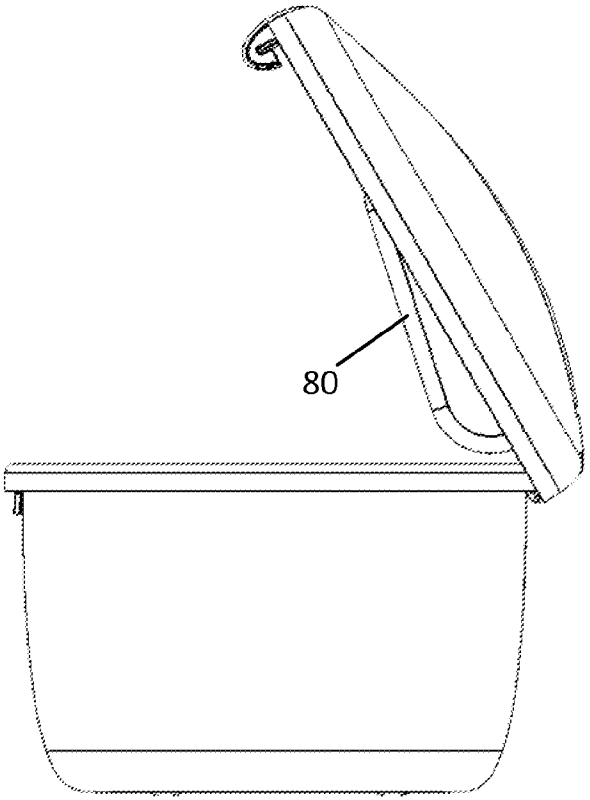
Figure 10:
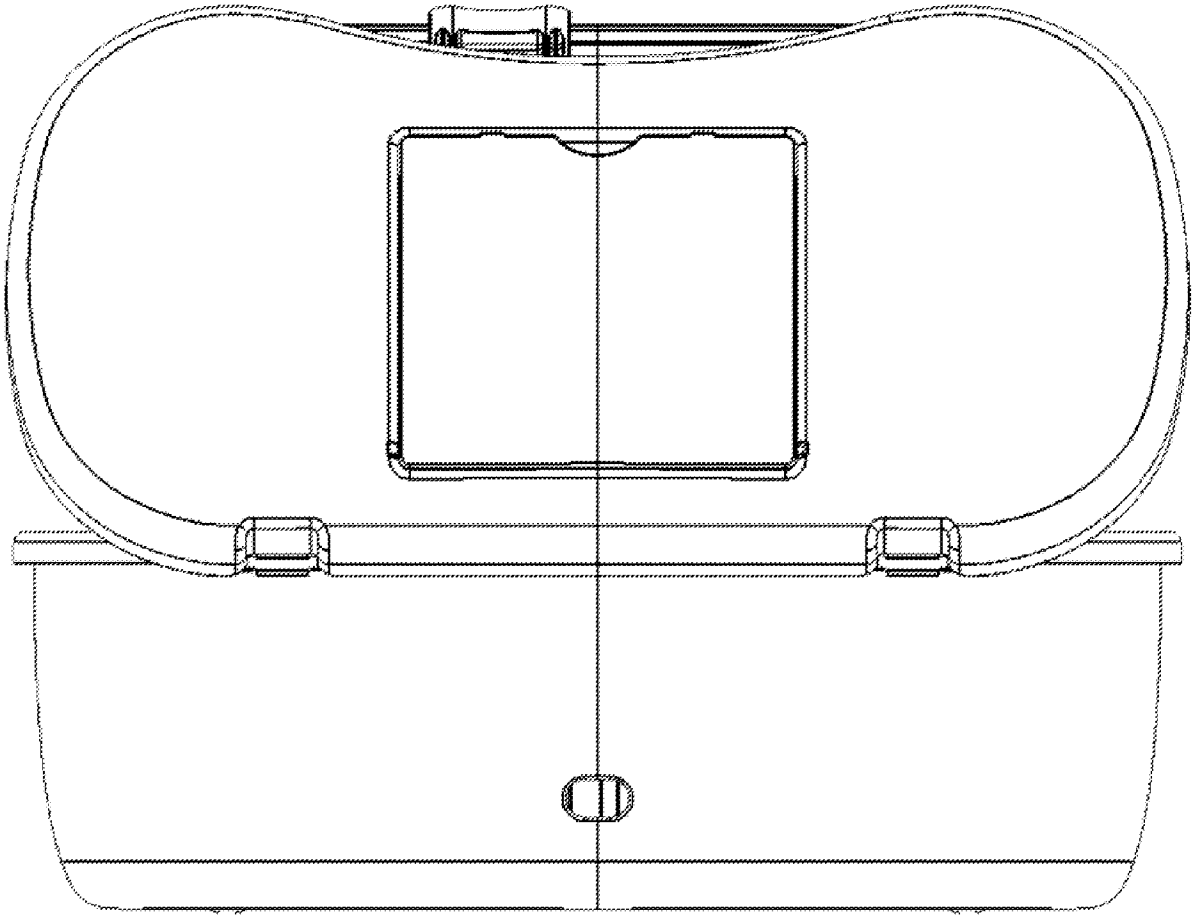
FIG. 10 is a back view of the storage system with the lid partially open.
Figure 11:
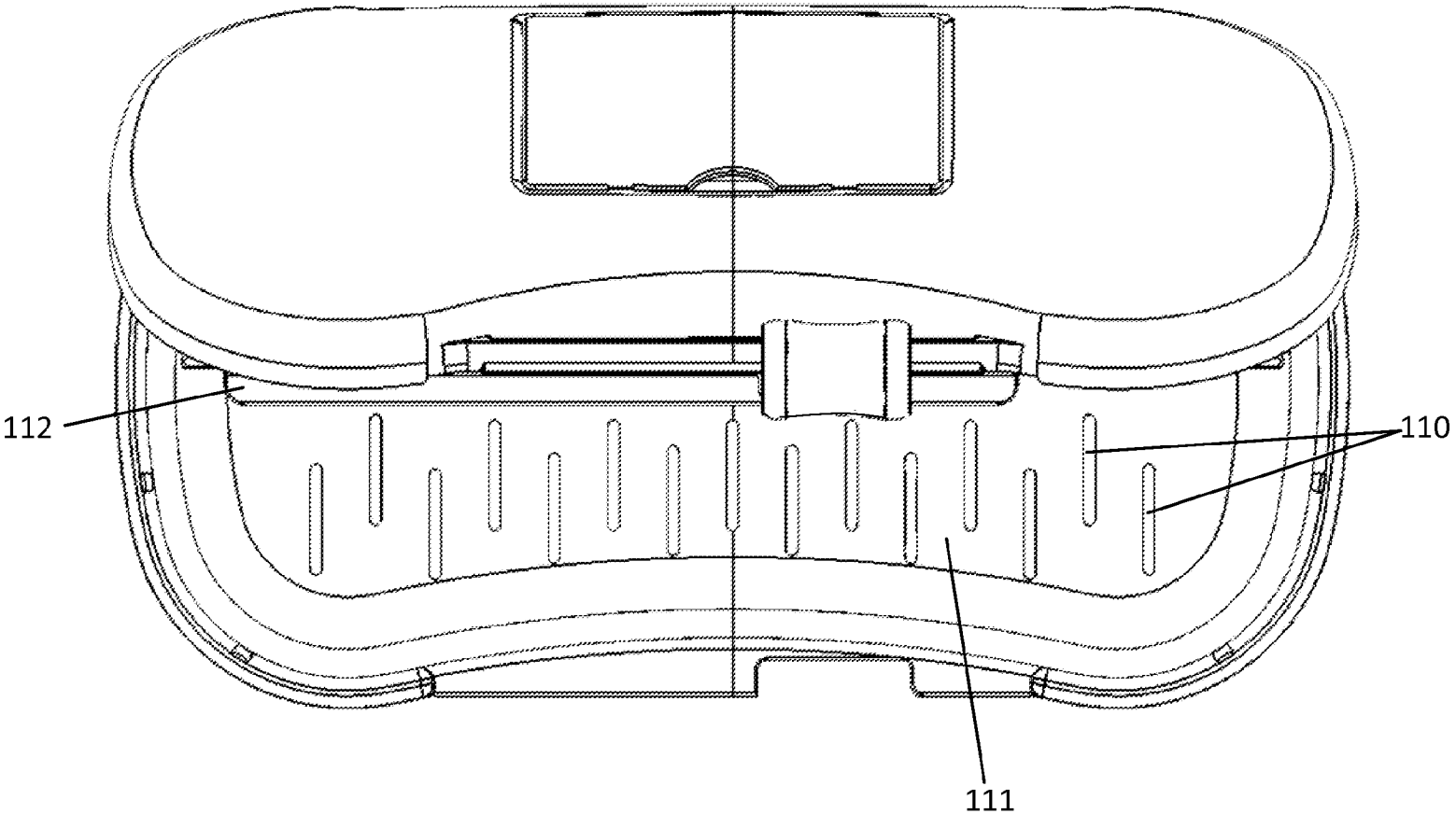
FIG. 11 is a top view of the storage system with the lid partially open and illustrating part of the tray in its storage position and ribs at the bottom of the inside of the box.
Figure 12:
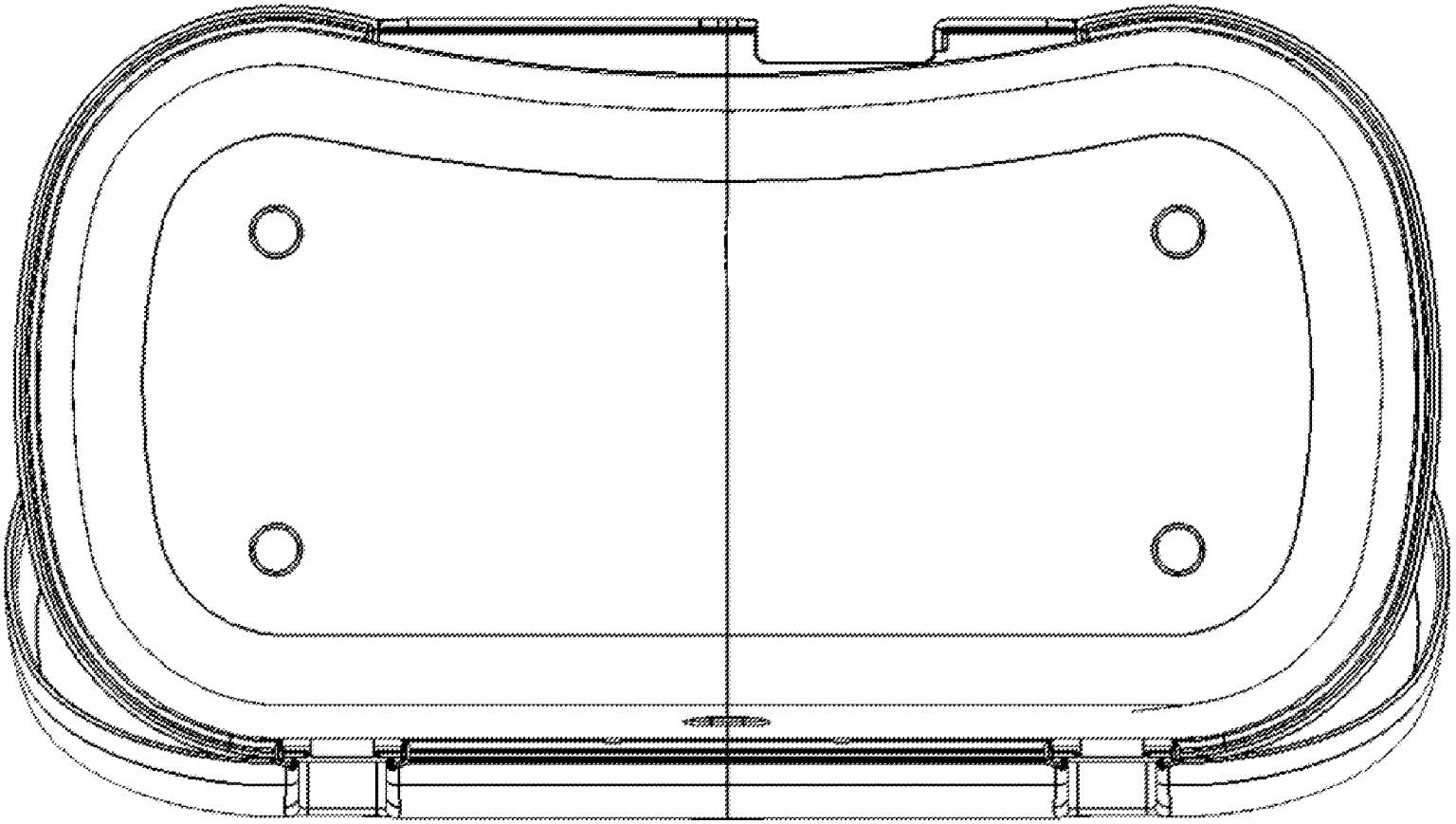
FIG. 12 is a bottom view of the storage system with the lid partially open.
Figure 13:
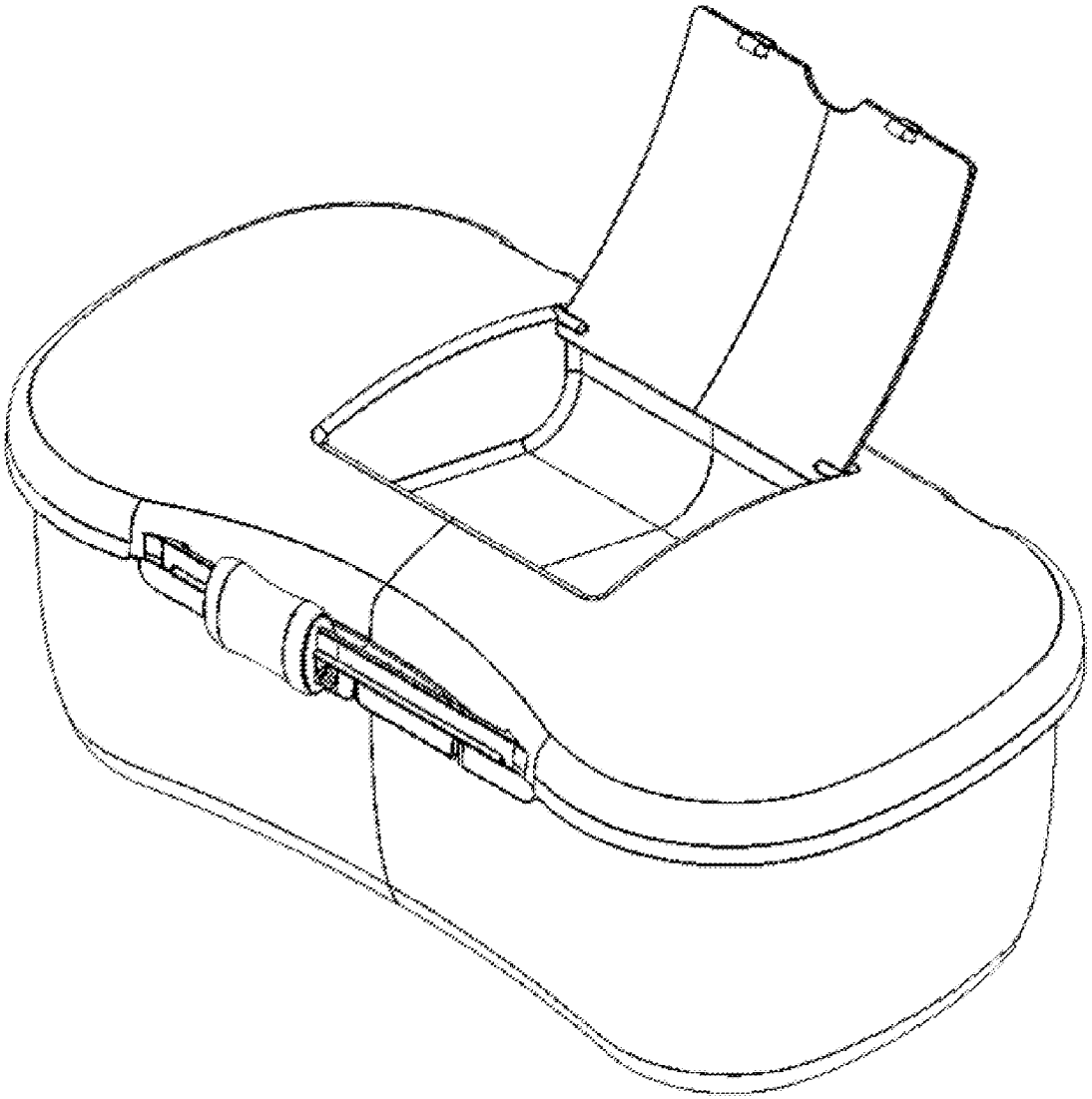
FIG. 13 is a perspective view of the storage system, with the mini lid within the lid open and illustrating the storage compartment within the lid.
Figure 14:
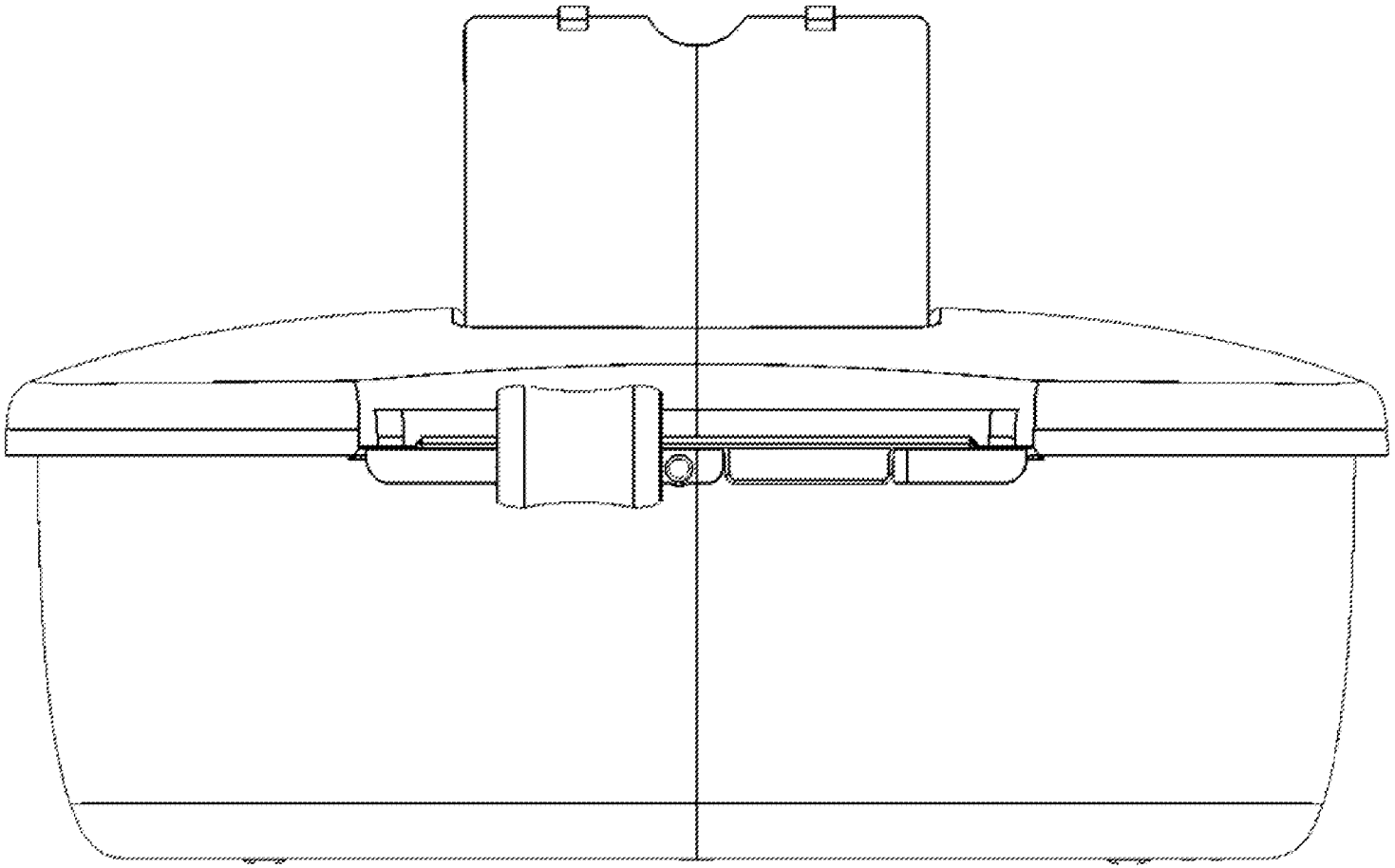
FIG. 14 is a front view of the storage system with the mini lid open.
Figure 15B:
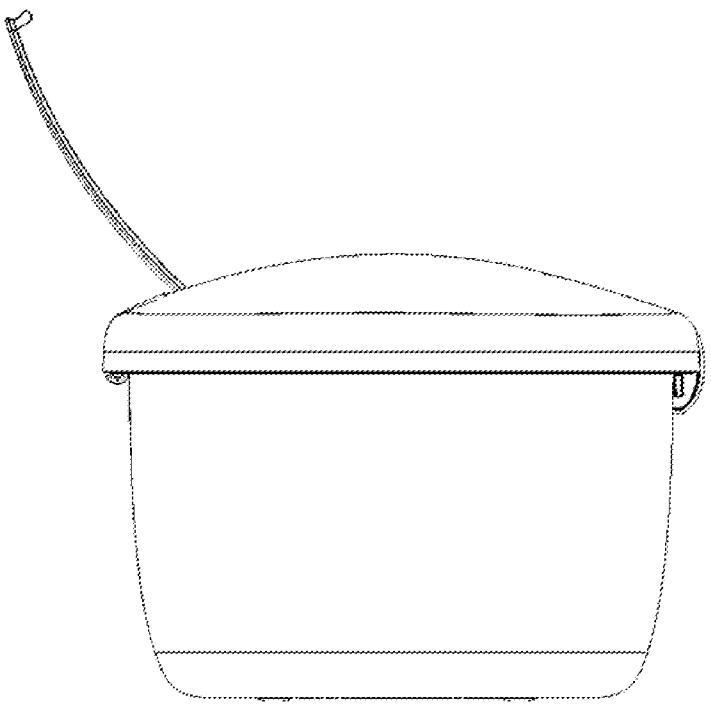
FIGS. 15A and 15B are left and right side views of the storage system with the mini lid open.
Figure 15A:
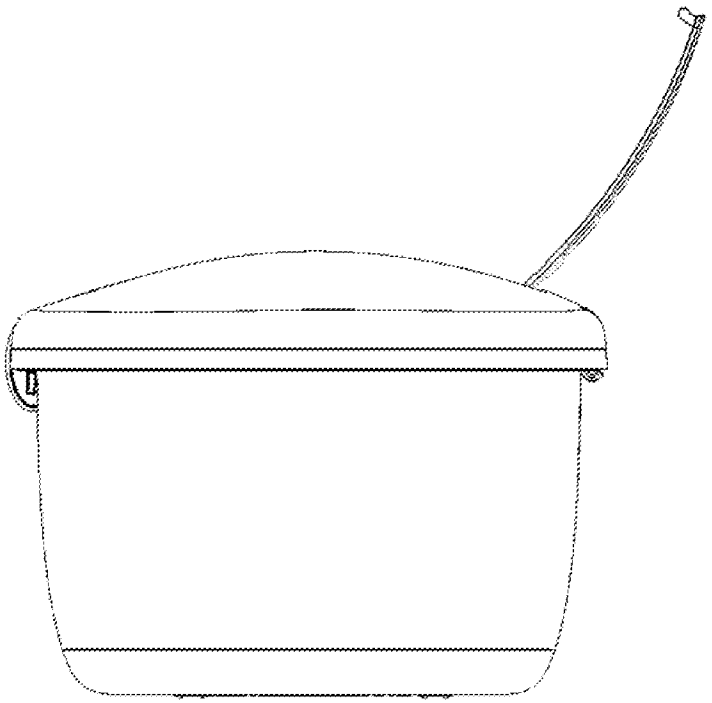
Figure 16:
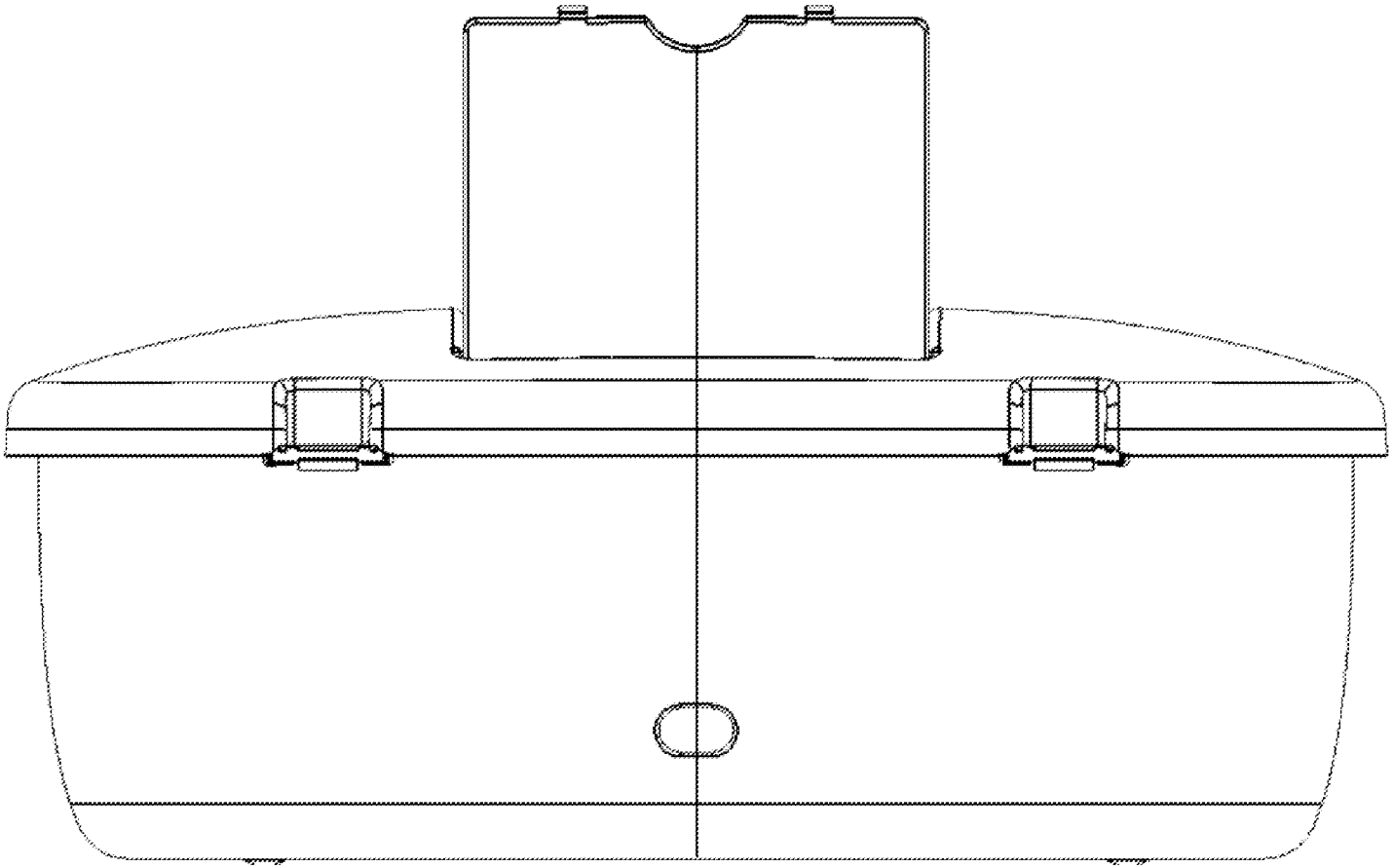
FIG. 16 is a back view of the storage system with the mini lid open.
Figure 17:
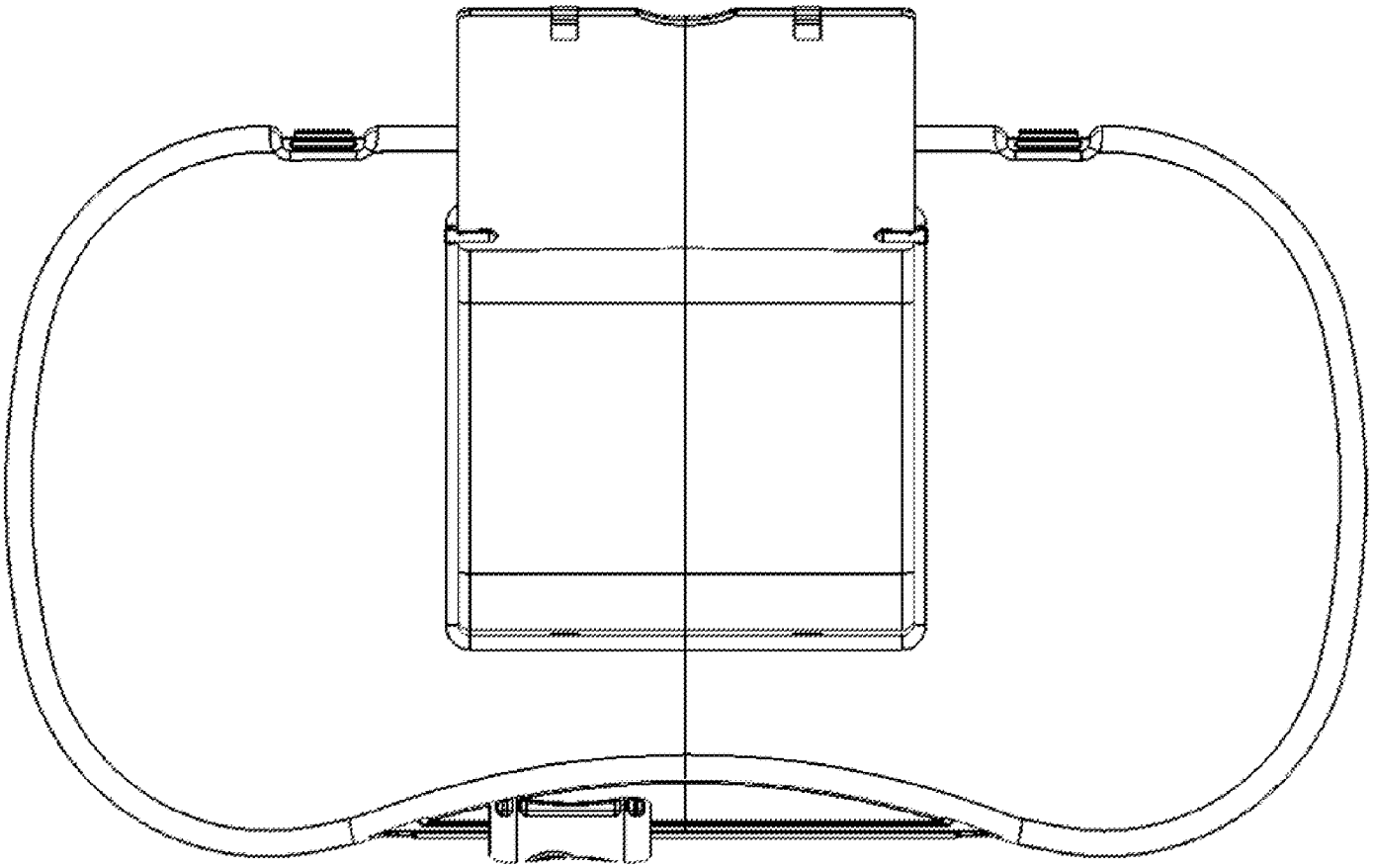
FIG. 17 is a top view of the storage system with the mini lid open.

The side views of the storage system illustrated in FIGS. 9A and 9B provide further details on the compartment 80 within the lid, which is deeper toward the back of the compartment where the mini lid is hinged and shallower toward the front of the compartment where the mini lid opens. This change in depth may enable bottles and other containers stored within the lid to roll back toward the deeper part of the compartment when first placed therein and to not readily roll and bump around within the compartment when the storage system is moved or the lid is opened, which may not otherwise be the case if the compartment had a level bottom or the deeper part was toward the front of the storage system. The compartment may, however, also be formed in the reverse, with the deeper part toward the front. FIG. 10 is a back view of the storage system with the lid partially open;

The inside of the storage system is further illustrated in FIG. 11, which is a top view of the storage system with the lid partially open. A series of offset ribs 110 are formed at the bottom 111 of the inside of the box so as to prevent objects from sticking to the plastic surface of the bottom of the box. FIG. 11 shows the ribs on the bottom of the box on one side of the tongue 112, but the same pattern of ribs may be on the bottom of the box on the other side of the tongue. In the absence of the ribs and the tongue for holding the tray in its storage position, the bottom of the box would be a smooth plastic surface. When certain adult products are placed on a smooth surface, the smooth surface of the product may adhere to the smooth surface of the bottom of the box, especially if moist from being recently washed, thereby making it difficult to remove the product from the box at some subsequent point in time, especially once the product has dried. Placing ribs on the bottom surface of the box serves to break up the smooth surface and make it easier to remove the objects once placed thereon. The ribs are offset to create greater variance to the surface of the bottom of the box, but need not be and may all be uniform in length and position. The number of ribs may be increased or decreased and the ribs need not be place front to back, but could be placed side to side, diagonally, or in other patterns, such as circles, X's, etc. Small bumps may also be used in place of the ribs if sufficiently spaced across the surface of the bottom of the box. The small bumps may be the size and shape of the feet on the bottom of the box, as shown in FIG. 12, or of other shapes and sizes. FIG. 11 also further illustrates the ventilation holes spaced around the rim of the box. FIG. 12 illustrates feet on the bottom of the box, but the box need not have feet and if it does have feet, the feet could be of a variety of shapes and sizes, such as the ribs of FIG. 11.

FIGS. 13-17 serve to further illustrate the mini lid and its associated compartment, as described above, when the mini lid within the lid is open and illustrating the storage compartment within the lid.

Figure 18A:
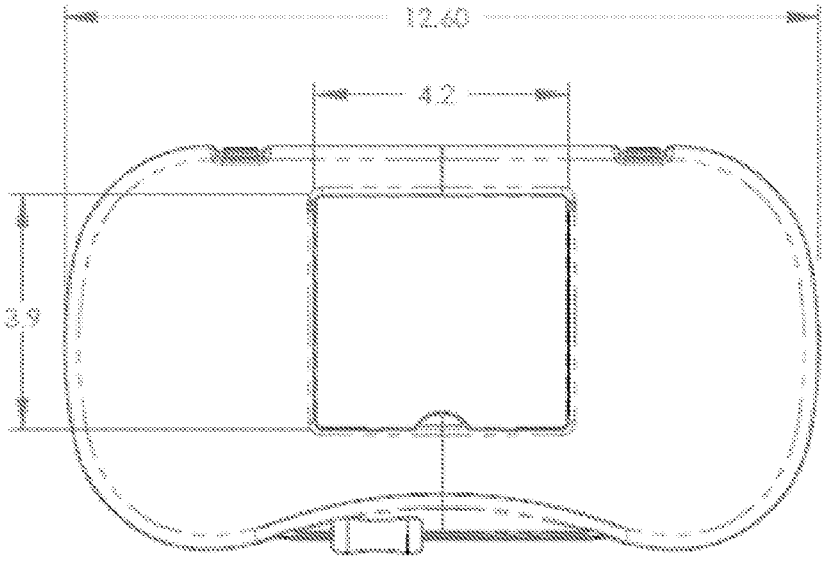
FIGS. 18A and 18B are top and front views of the storage system illustrating optional dimensions.
Figure 18B:
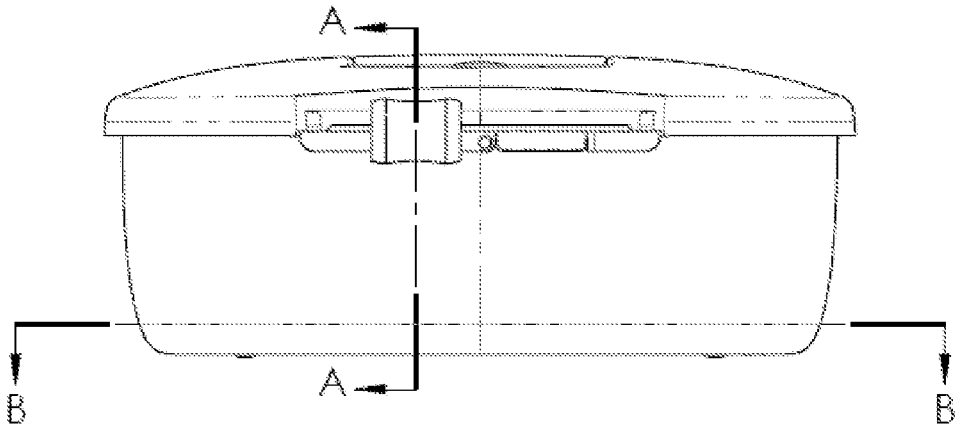
Figure 18C:
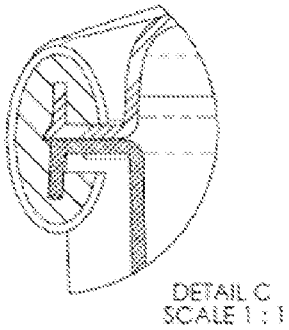
FIG. 18C is a cut-away side view of the storage system, with the tray in its storage position, illustrating optional dimensions and an enlarged view of the locking mechanism.
Figure 18C:
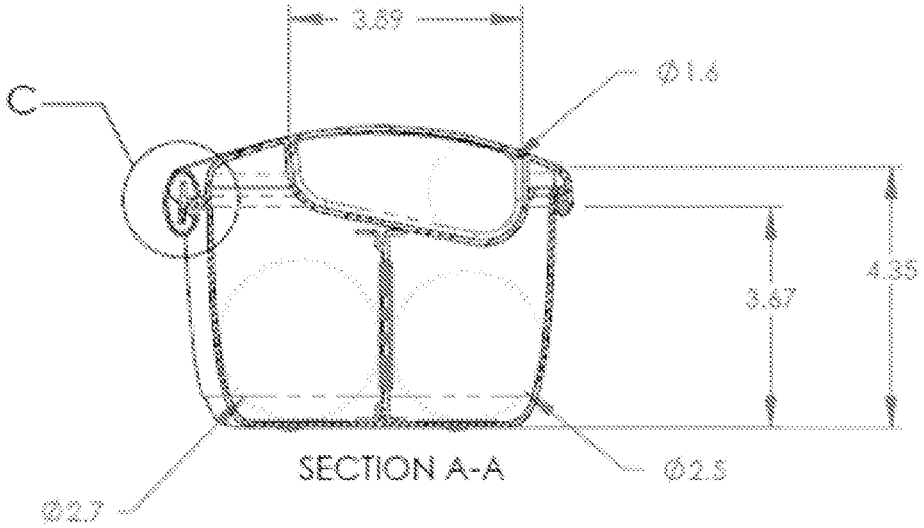

Exemplary dimensions are illustration in FIGS. 18A-D. FIG. 18A illustrates the top of the storage system, with the lid approximately 12.60 inches wide and the tray approximately 4.2 inches wide by approximately 3.9 inches deep. FIG. 18B illustrates the side of the box with two cross sections A-A and B-B shown. Cross-section A-A is further illustrated in FIG. 18C, which better illustrates the inside of the storage system, an exemplary height, and the relative size of the compartment within the lid. FIG. 18C also shows an enlarged view of the area C, including the locking mechanism, with a bottom rail formed by a side of the bottom of the box meeting the top rail formed a side of the lid and being held together by the slider. FIG. 18C also shows the tray mounted on the tongue in its storage position, which essentially divides the inside of the box into two sections capable of holding multiple objects on either side of the tray, one side capable of holding an object having a diameter of approximately 2.7 inches and the other side capable of holding an object having a diameter of approximately 2.5 inches. The compartment within the lid may hold an object having a diameter of approximately 1.6 inches. Cross-section BB is further illustrated in FIG. 18D, which provides exemplary dimensions for the bottom of the box, illustrates how the tray in its storage position divides the box length-wide, and how the pattern of ribs on the bottom surface of the inside of the box are replicated on both sides.

Figure 19A:
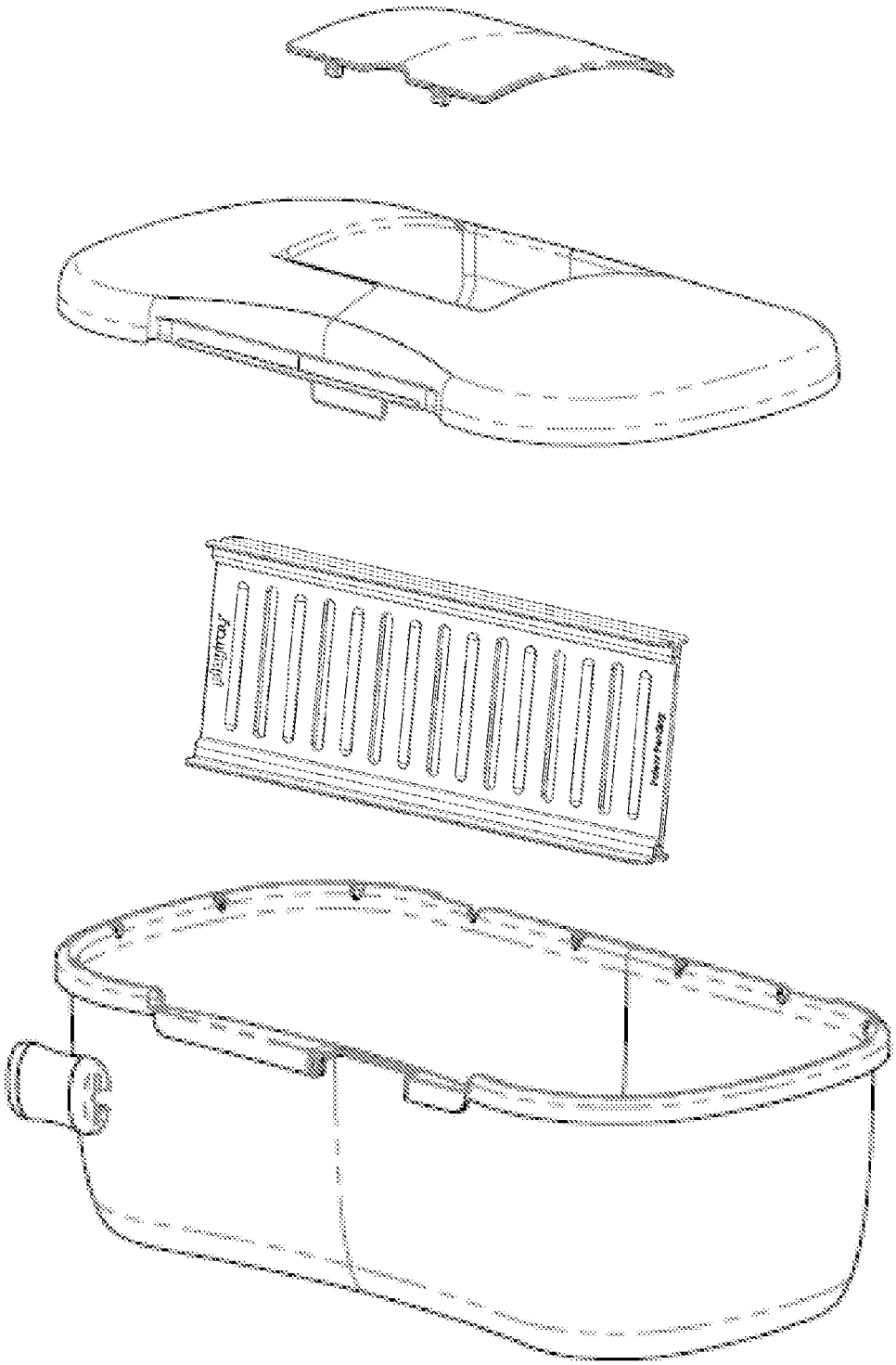
FIG. 19A is an exploded perspective view of the storage system.
Figure 19B:
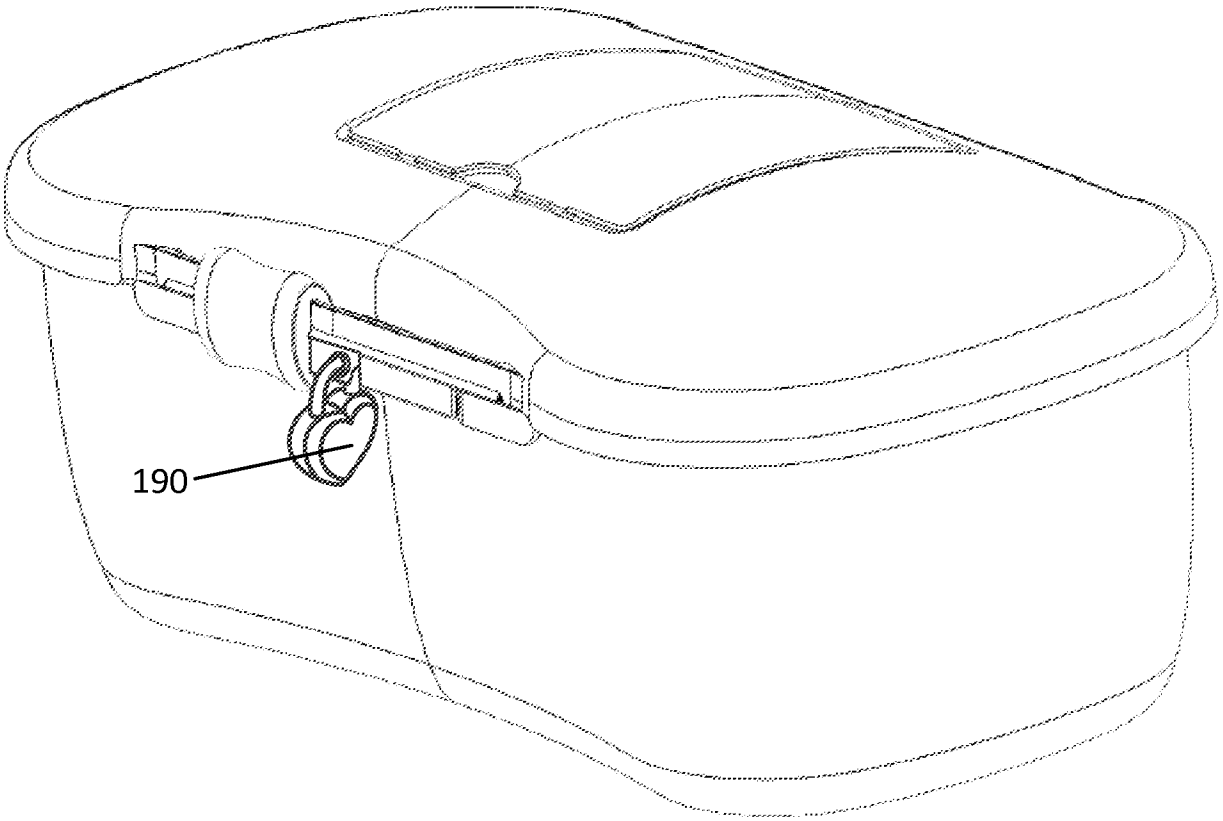
FIG. 19B is a perspective view of the storage system illustrating the optional mini lock.

FIG. 19 is an exploded perspective view of the storage system, showing the lid detached from the box, the mini lid detached from the lid, and the tray, in its storage position detached from the box. The sliding lock is also shown removed from the top and bottom rails of the box. In FIG. 19B, the storage system is reassembled, the sliding lock 190 is moved to its locking position, and an optional mini lock is placed through a hole formed in the bottom rail. The mini lock is in the form of a small heart.

Figure 20:
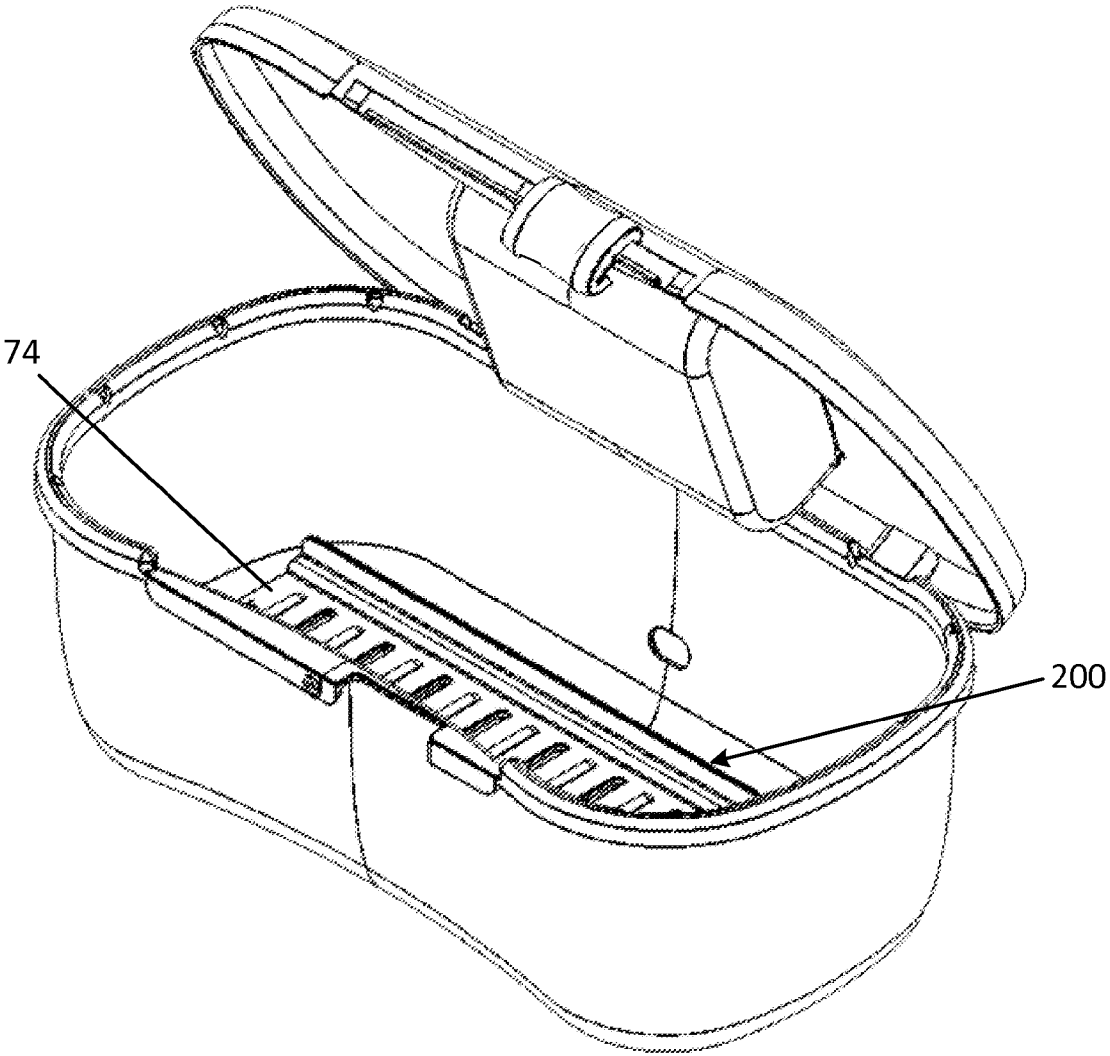
FIG. 20 is a perspective view of the storage system illustrating the tray in its working position within the box when the lid is open.
Figure 21:
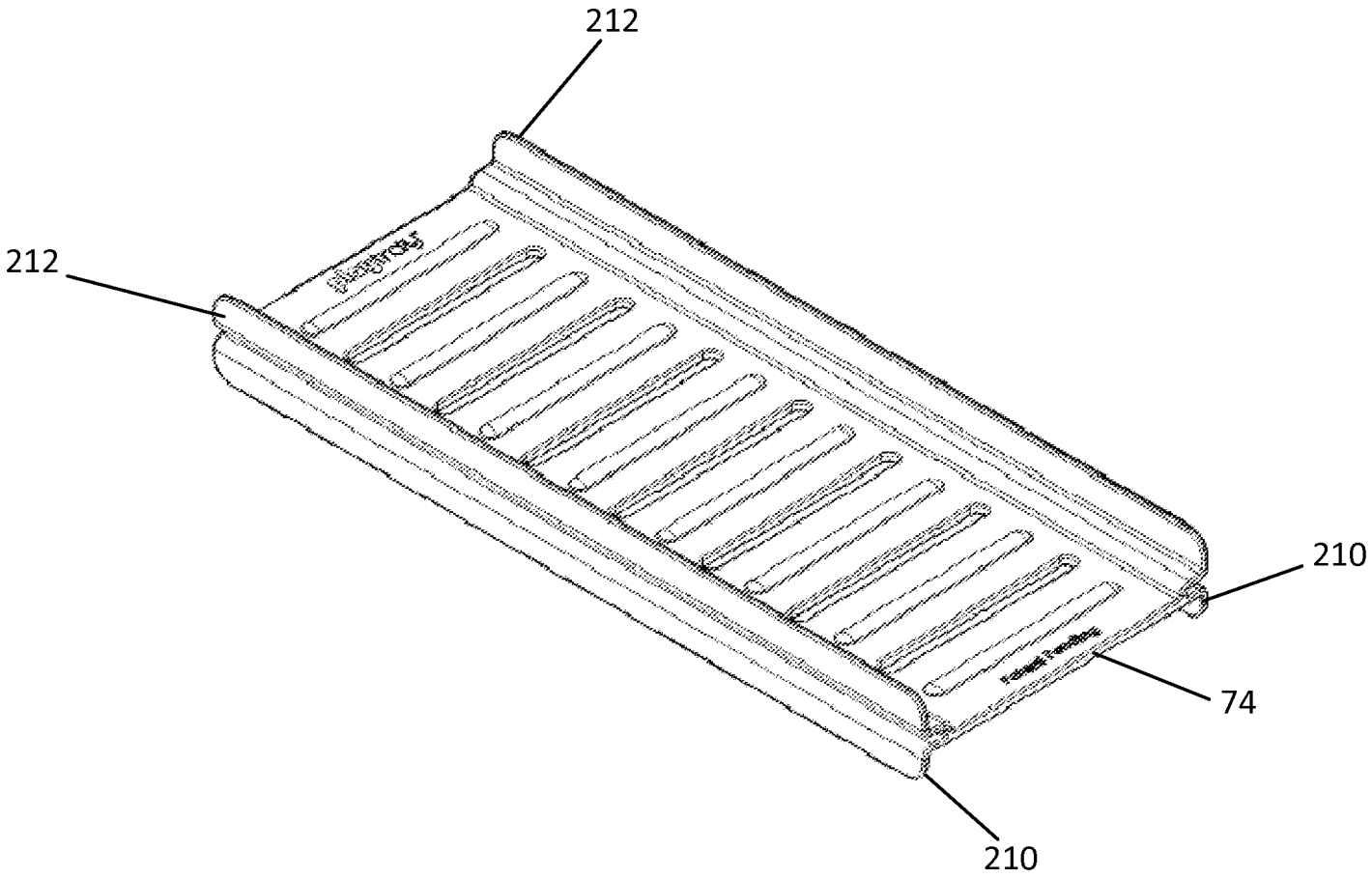
FIG. 21 is a perspective view of the tray removed from the box.
Figure 22A:
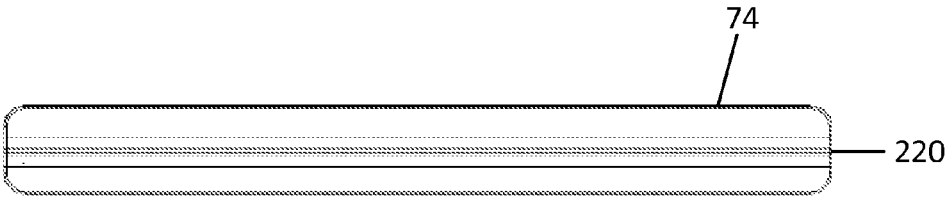
FIGS. 22A, 22B, 22C and 22D are a left side, top, right side and bottom views of the tray.
Figure 22B:
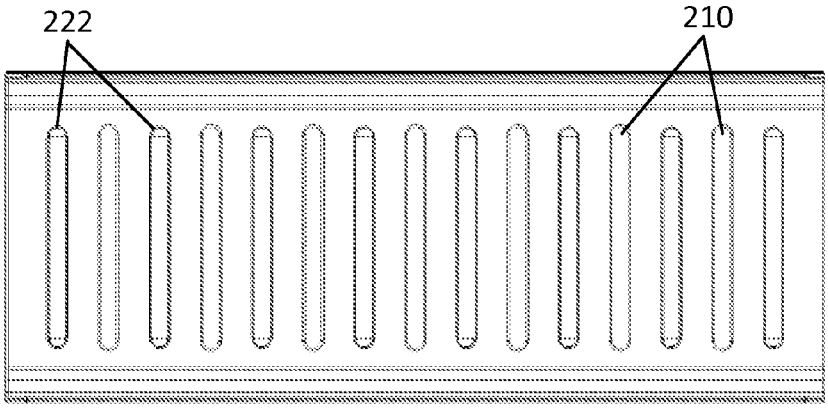
Figure 22C:
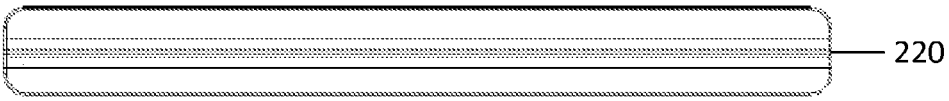
Figure 22D:
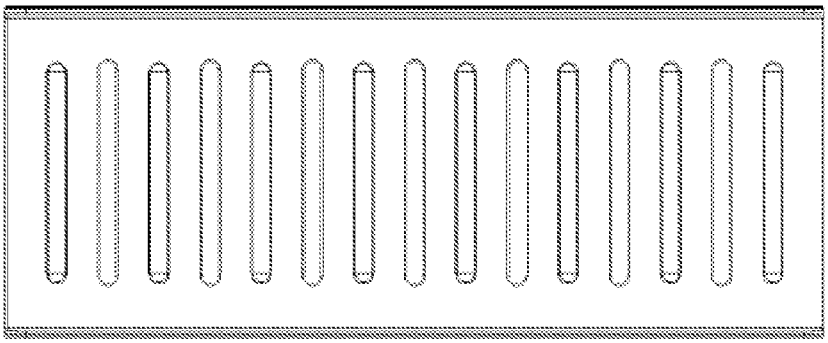

FIG. 20 is a perspective view of the storage system illustrating the tray 74 in its working position 200 within the box when the lid is open. The storage tray may be allowed to move freely around the bottom of the box or may be held, lightly in place, by the offset of the ribs on the bottom of the box. The tray itself may be formed of the same material as the box and include both ribs and slots. The ribs prevent objects from sticking to the tray and the slots help to ventilate objects placed on the tray so they can dry. As shown in FIG. 21, the tray 74 may be removed from the storage system and used separately outside of the box. The tray is reversible and includes legs 210 formed by the sides of the tray that support the tray off the surface of whatever it is resting upon, such as the bottom of the box or a table. The inverse legs 212 form ledges in the front and the back of the tray so that rounded objects placed on the tray roll toward the ledges and are retained on the tray by the raised ledges. FIGS. 22A, 22B, 22C and 22D provide left side, top, right side and bottom views of the tray and further illustrate the groves 220 on either side and the ribs 222 and slots 224 formed on either side of the tray 74.

Figure 23:
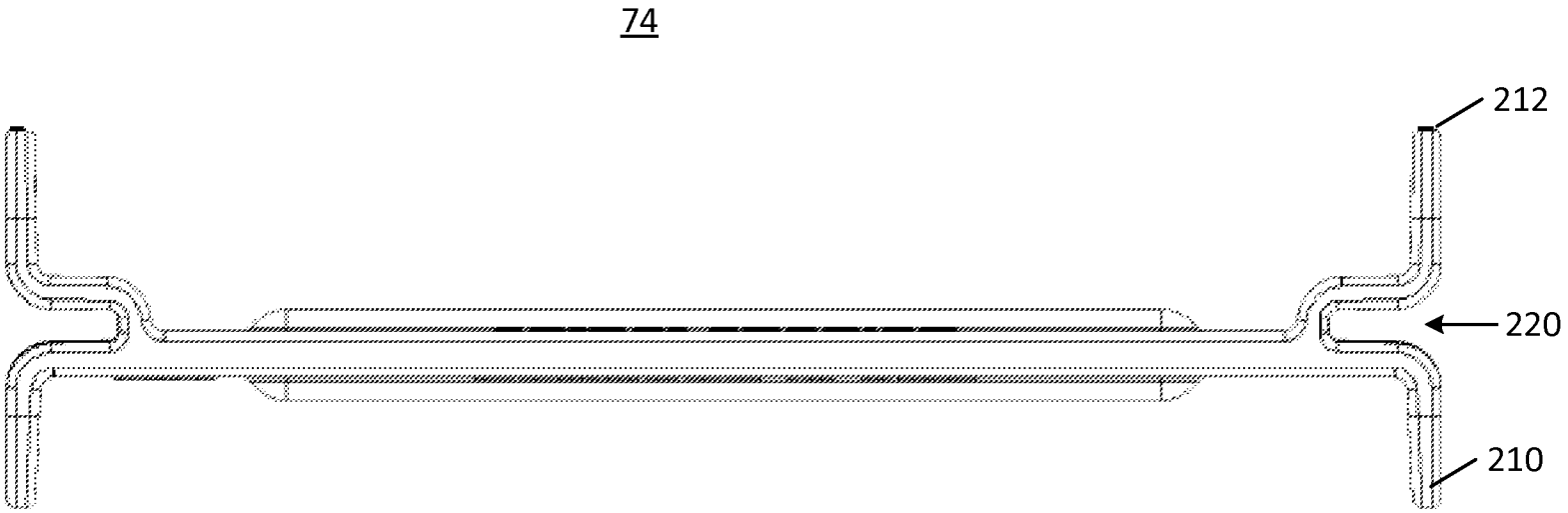
FIG. 23 is a view of one end of the tray.

FIG. 23 is a view of one end of the tray 74 illustrating how the groove is formed between the legs 210 formed by the sides, with one leg slightly offset from the other so as to leave room for formation of the groove. This results in the groove not being exactly centered between the legs and allows the user to decide whether the tray is set down on its short legs 210 or its long legs 212. The long legs 212 may be used as legs when more distance and air separation is desired between the tray and a surface on which the tray is placed, which the short legs 210 may be used as legs when air separation is not important and a the long legs are needed as ledges to prevent an object placed on the tray from rolling off.

Figure 18D:
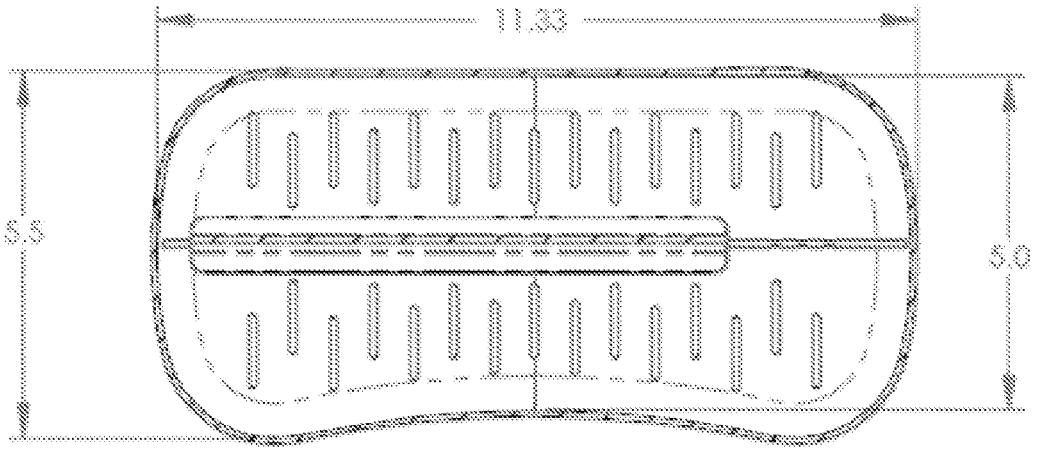
FIG. 18D is a cut-away top view of the storage system, with the tray in its storage position, illustrating the ribbed bottom of the box and optional dimensions.
Figure 24:
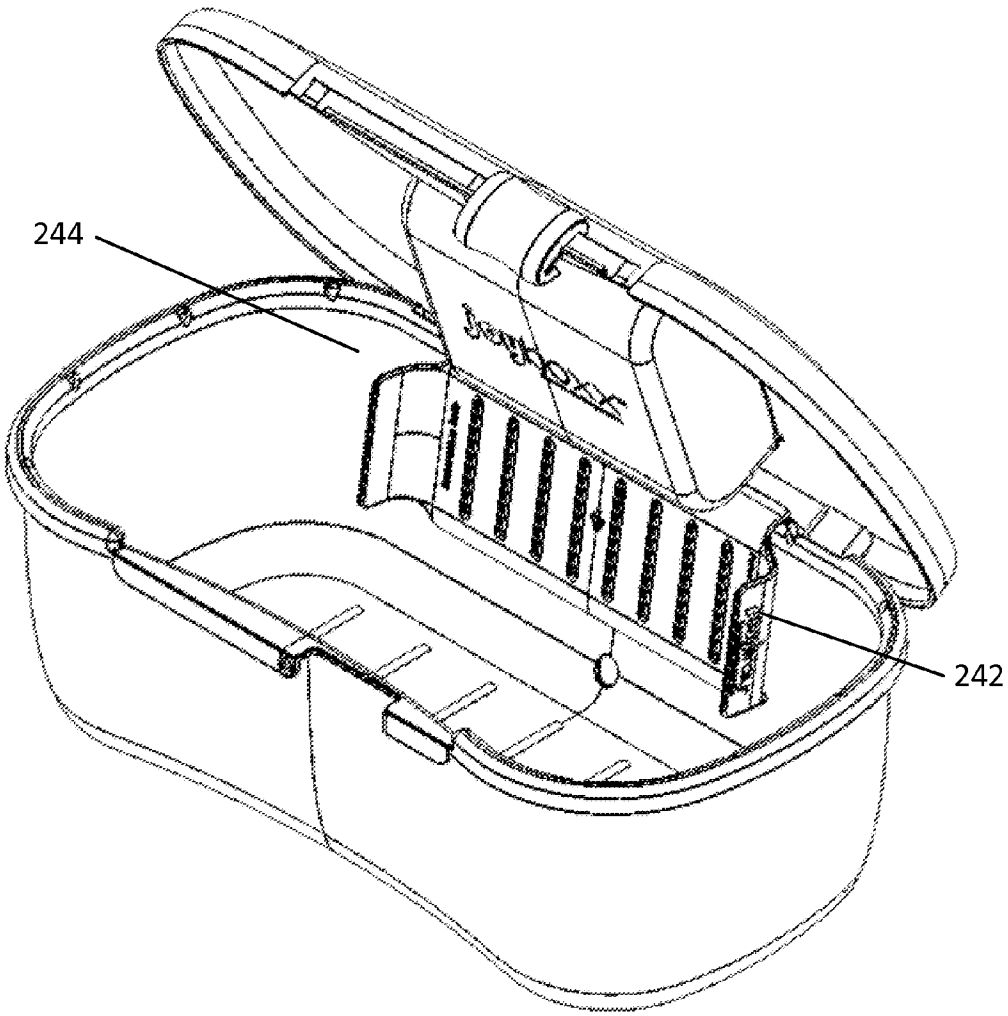
FIG. 24 is a perspective view of the storage system, with the lid partially opened and illustrating an alternative tray in an alternative storage position at the back inside wall of the box.
Figure 25:
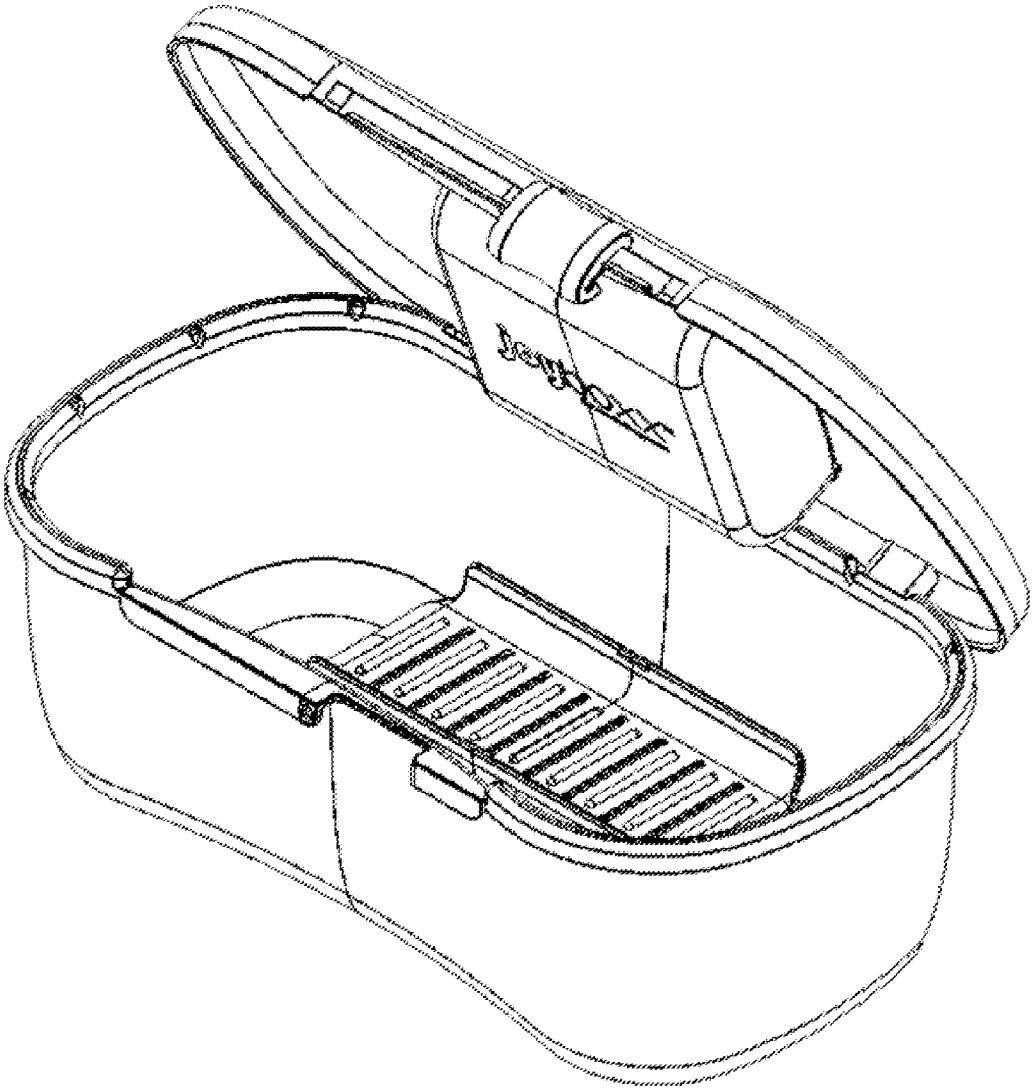
FIG. 25 is a perspective view of the storage system illustrating the alternative tray in an alternative working position within the box when the lid is open.
Figure 26:
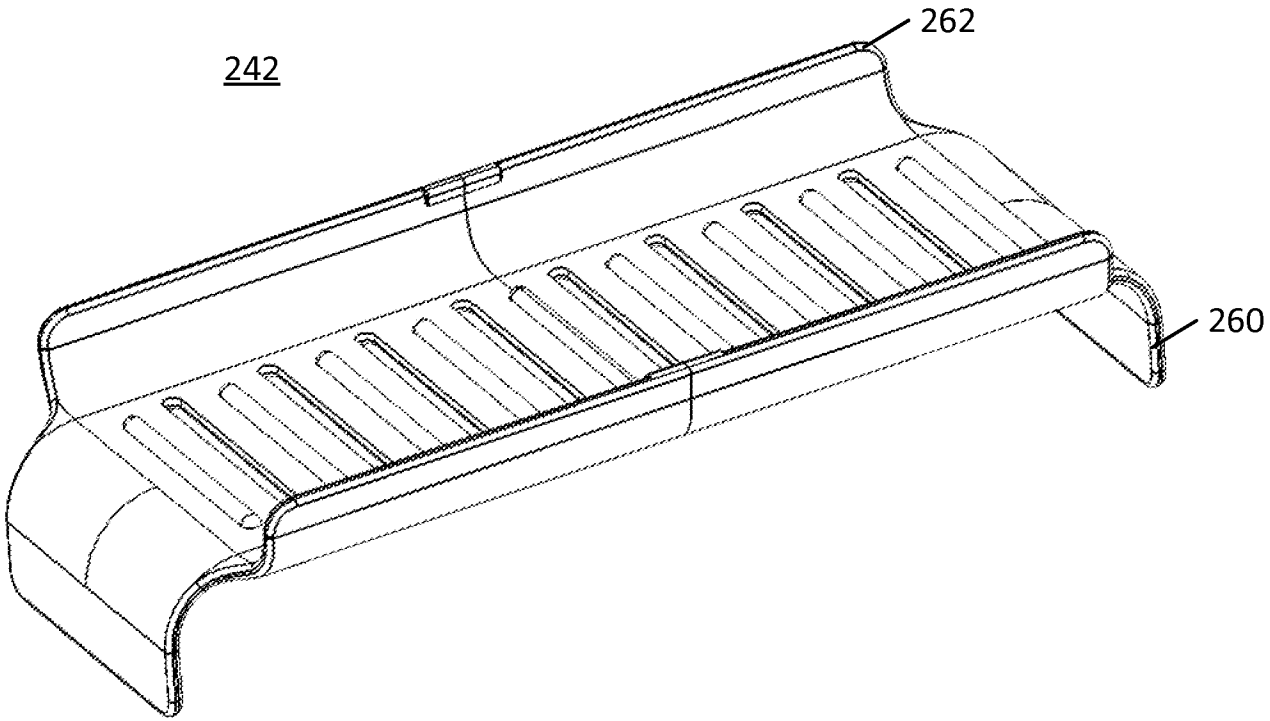
FIG. 26 is a perspective view of the alternative tray removed from the box.

FIG. 24 is a perspective view of the storage system 240, with the lid partially opened and illustrating an alternative tray 242 in an alternative storage position at the back inside wall 244 of the box. The alternative tray 242 has a different shape from the tray 74 illustrated and described above. As shown in FIG. 26, the alternative tray 242 has an extended leg 260 on either end that allow the main portion of the tray to be lifted off the ground and arms 262 on each side that prevent items from rolling off the tray. While the working position of the tray, as depicted in FIG. 25 in a similar position as that depicted for the tray in FIG. 20, the extended length of the legs of the alternative tray causes the alternative tray to sit up higher within the box. When not in use, the alternative tray is stored in an alternative storage position on the back inside wall of the box instead of on the raised tounge at the bottom of the box as illustrated in FIGS. 18C and 18D.

Figure 27A:
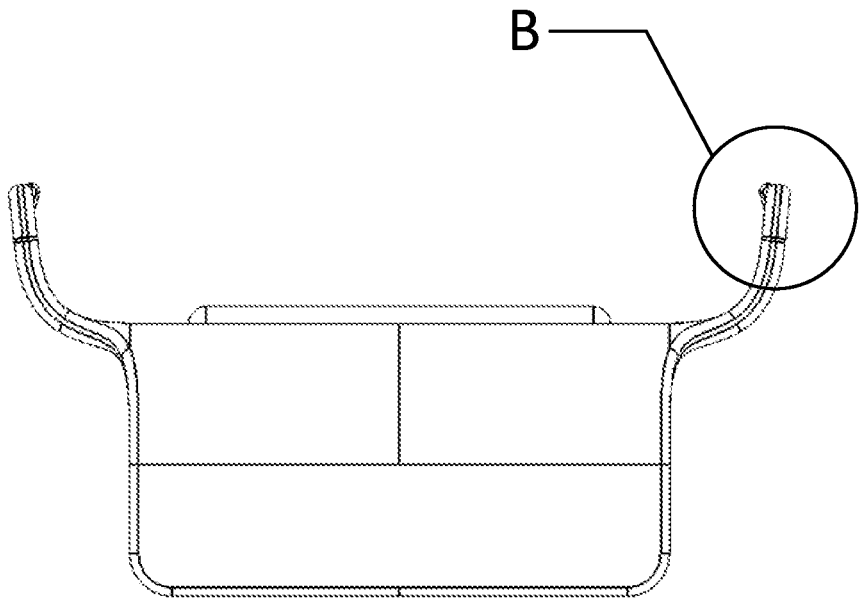
FIG. 27A is a view of one end of the alternative tray illustrating one leg and two side arms.
Figure 27B:
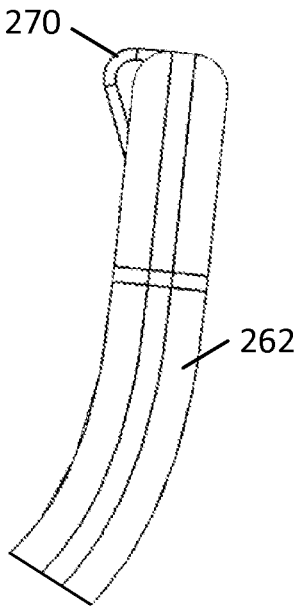
FIG. 27B is an enlarged view of the rib of one side arm from FIG. 27A.

FIGS. 27A and 27B further illustrate the shape of the alternative tray and the nubs 270 formed in an upper center portion of each arm that enable the alternative tray to be stored on a lip of the edge of the box, as shown in FIG. 24.

Aspects of the embodiments described herein may be used independently of one another, or combined in a variety of ways. All possible combinations and sub-combinations are intended to fall within the scope of the present disclosure. Various elements depicted in the figures may be added, removed, rearranged, or reconnected in various ways to form alternative embodiments. The embodiments described herein have been provided as examples, and are not intended to limit the scope of the present disclosure. Nothing in the description provided is intended to imply that any particular feature, characteristic, operation, or other element is required.

Conditional language such as "can," "could," "may," "might," "for example," and so on is generally intended to convey that some embodiments include the recited element while other embodiments do not. Accordingly, unless specifically stated otherwise or required by context, such language is not intended to imply that the recited element is a mandatory component of any particular embodiment. The terms "comprising," "having," "including" and so forth do not exclude additional elements. When the term "or" is used to connect a list of elements, it is used inclusively to refer to one or more of the elements of the list.

What is claimed:

1. A storage system, comprising;

a box having a front, back, bottom and two sides forming an opening configured to have sufficient depth from an upper rim formed by the front, back and two sides to the bottom to hold one or more of a variety of differently shaped objects, the upper rim having a plurality of ventilation holes formed therein, the box having a split lower rail on the front;

a lid having a front, a back and a top, the back of the lid being hinged to the back of the box and configured to mate with the upper rim of the box without closing the plurality of ventilation holes, the lid including a compartment formed within the top of the lid and having a mini lid covering the compartment, the lid having an upper rail with a bottom projection tab on the front; and a locking mechanism including a sliding lock for securing the lid to the box, the sliding lock configured to fit over the lower rail and the upper rail, the locking mechanism configured to be formed when the lower rail and the upper rail are mated by the mating of the lid to the box and the sliding mechanism is moved so as to fit over both the lower rail and the upper rail at the same time.

2. The storage system as recited in claim 1, wherein the split lower rail forms an indented area where the sliding lock does not fit over the lower rail, the locking mechanism being unlocked when the sliding lock is positioned over the indented area.

3. The storage system as recited in claim 1, wherein the split lower rail includes a raised bump area that is configured to create resistance against the sliding lock when the sliding lock is moved from a locked position to an unlocked position.

4. The storage system as recited in claim 3, wherein the raised bump area includes a through hole for a shackle of a pad lock for securing the sliding lock in the locked position.

5. The storage system as recited in claim 1, wherein the compartment has a front end, a back end and a bottom end and the bottom end is not parallel to the bottom of the box.

6. The storage system as recited in claim 1, wherein the upper rail includes a ridge that extends along a length of the upper rail, wherein the sliding lock forms a recess that mates with the ridge, and wherein the sliding lock snaps onto the upper rail when installed and the ridge is forced into the recess.

7. The storage system as recited in claim 1, wherein the bottom of the box includes an inside surface and the inside surface includes a plurality of raised ribs.

8. The storage system as recited in claim 1, wherein a through hole is formed in the back of the box toward the bottom.

9. The storage system as recited in claim 1, wherein the bottom of the box includes an outside surface and the outside surface includes a plurality of raised feet.

10. The storage system as recited in claim 1, further comprising a tongue formed on the bottom of the box and a tray having a groove formed on one or more sides of the tray, wherein the groove of the tray is placed over the tongue when the tray is in a storage position, wherein the tongue is positioned along a centrally located length of the bottom, and wherein the tray separates the opening into two portions for holding separate objects.

11. The storage system as recited in claim 10, wherein the one or more sides of the tray include a first side and a second side opposite the first side, wherein the tray further includes a first surface and a second surface opposite the first surface, wherein a first set of legs is formed on either side of the first surface by the first side and the second side and wherein a second set of legs is formed on either side of the second surface by the first side and the second side, the first set of legs configured to support the tray in a first working position and the second set of legs configured to support the tray in a second working position.

12. The storage system as recited in claim 11, wherein each leg among the first set of legs includes a first bend that forms the groove between each leg of the first set of legs and each leg of the second set of legs on the first side and the second side, wherein the groove mates with the tongue to hold the tray in the storage position, the first set of legs being longer than the second set of legs.

13. The storage system as recited in claim 12, wherein the tray includes a plurality of through slots formed within a bottom of the tray.

14. The storage system as recited in claim 13, wherein the tray includes a plurality of raised ribs formed on the bottom of the tray.

15. The storage system as recited in claim 1, wherein at least the box and the lid are formed from a sanitary plastic material.

16. The storage system as recited in claim 15, wherein the sanitary plastic material includes an antimicrobial additive.

17. The storage system as recited in claim 1, further comprising a tray having at least two arms, at least two legs, and at least one nub formed on one or more arms of the tray, wherein the nub is placed over the upper rim when the tray is in a storage position, and wherein the at least two legs are configured to support the tray in a working position.

* * * * *